US005727386A

United States Patent [19]

Watanabe et al.

[11] Patent Number: 5,727,386

[45] Date of Patent: Mar. 17, 1998

[54] STRUCTURE OF AN EXHAUST MANIFOLD BRANCH COLLECTING PORTION

[75] Inventors: Yoshimasa Watanabe, Shizuoka-ken; Makoto Yokota, Anjyo; Shigeki Yasuhara, Toyota; Kazuhisa Mikame, Nagoya; Satoru Takahashi, Toyota, all of Japan

[73] Assignee: Toyota Jidosha Kabushiki Kaisha, Toyoyta, Japan

[21] Appl. No.: 626,737

[22] Filed: Apr. 2, 1996

[30] Foreign Application Priority Data

Apr. 3, 1995 [JP] Japan ..... 7-077458
Oct. 30, 1995 [JP] Japan ..... 7-281229

[51] Int. Cl.[6] ..... F01N 7/10

[52] U.S. Cl. ..... 60/323; 60/313; 60/322; 285/150

[58] Field of Search ..... 60/272, 322, 323, 60/313; 285/150; 137/602; 29/890.08, 890.125

[56] References Cited

U.S. PATENT DOCUMENTS

| | | | |
|---|---|---|---|
| 1,792,983 | 2/1931 | Hull | 285/150 |
| 2,847,819 | 8/1958 | Muller | 60/29 |
| 4,031,700 | 6/1977 | Yamazaki et al. | 60/322 |
| 4,182,121 | 1/1980 | Hall | 60/313 |
| 4,373,329 | 2/1983 | Martini | 60/305 |
| 5,010,731 | 4/1991 | Onishi | 60/313 |

FOREIGN PATENT DOCUMENTS

| | | |
|---|---|---|
| A-284466 | 9/1988 | European Pat. Off. . |
| 0 380 407 A1 | 8/1990 | European Pat. Off. . |
| A-2203426 | 5/1974 | France . |
| 3832728 A1 | 4/1989 | Germany . |
| 57-143119 | 9/1981 | Japan . |
| 57-86514 | 5/1982 | Japan . |
| A-62-197620 | 9/1987 | Japan . |
| 51819 U | 1/1993 | Japan . |
| 544507Y2 | 11/1993 | Japan . |

*Primary Examiner*—Stephen F. Husar
*Assistant Examiner*—Ljiljana V. Ciric
*Attorney, Agent, or Firm*—Kenyon & Kenyon

[57] ABSTRACT

A collecting portion for an exhaust manifold branch where a combined pipe portion including a plurality of pipes is welded to a collecting pipe wherein, (1) an intermediate member is provided between the combined pipe portion and the collecting pipe, (2) the collecting pipe has a portion that extends upstream, (3) a weld line formed at the downstream end of a partitioning wall is axially zigzagged, (4) a weld line is offset from the downstream surface of the combined pipe portion, (5) only one of the partitioning walls is curved, (6) downstream ends of the partitioning walls are smoothly convex, (7) an additional weld is formed in the partitioning wall, or (8) an intermediate member is welded at a half circumference of the combined pipe portion.

4 Claims, 23 Drawing Sheets

STRUCTURE OF AN EXHAUST MANIFOLD BRANCH COLLECTING PORTION

BACKGROUND OF THE INVENTION

1. Field of the Invention

The present invention relates to a collecting portion of an exhaust manifold branch constructed by combining and welding a plurality of pipes to each other.

2. Description of Related Art

A collecting portion of an exhaust manifold branch constructed by shaping the ends of a plurality of pipes into pie-shaped cross-sections, combining and welding the pie-shaped ends to form an exhaust manifold, inserting the combined pipe portion into a collecting pipe, and welding the combined pipe portion to the collecting pipe is known, for example, by Japanese Utility Model Unexamined Publication No. HEI 5-1819.

Conventional structures with exhaust manifold branch collecting portions are classified into two groups: i) where the pipe collecting portion is located relatively close to the engine's cylinder head; and ii) where the pipe collecting portion is located relatively far from the engine's cylinder head.

However, these conventional structures have the following problems.

First, it is difficult to maintain a high structural integrity at the exhaust manifold branch collecting portion for the following reasons: i) large thermal stresses exist at the portion; ii) the temperature of the portion is high where the partitioning walls cross; and iii) weld lines intersect where the partitioning walls cross.

Second, if both of the partitioning walls are locally curved where they cross each other, the overall stiffness of the portion's cross-section is reduced. As a result, relatively large distortions occur at this portion, which promotes, in some cases, crack generation in the welded portions.

SUMMARY OF THE INVENTION

An object of the present invention is to provide an exhaust manifold branch collecting portion with increased structural integrity.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENT

Sixteen embodiments of the present invention will be explained below. These sixteen embodiments can be classified into the following eight groups.

Figure 1:
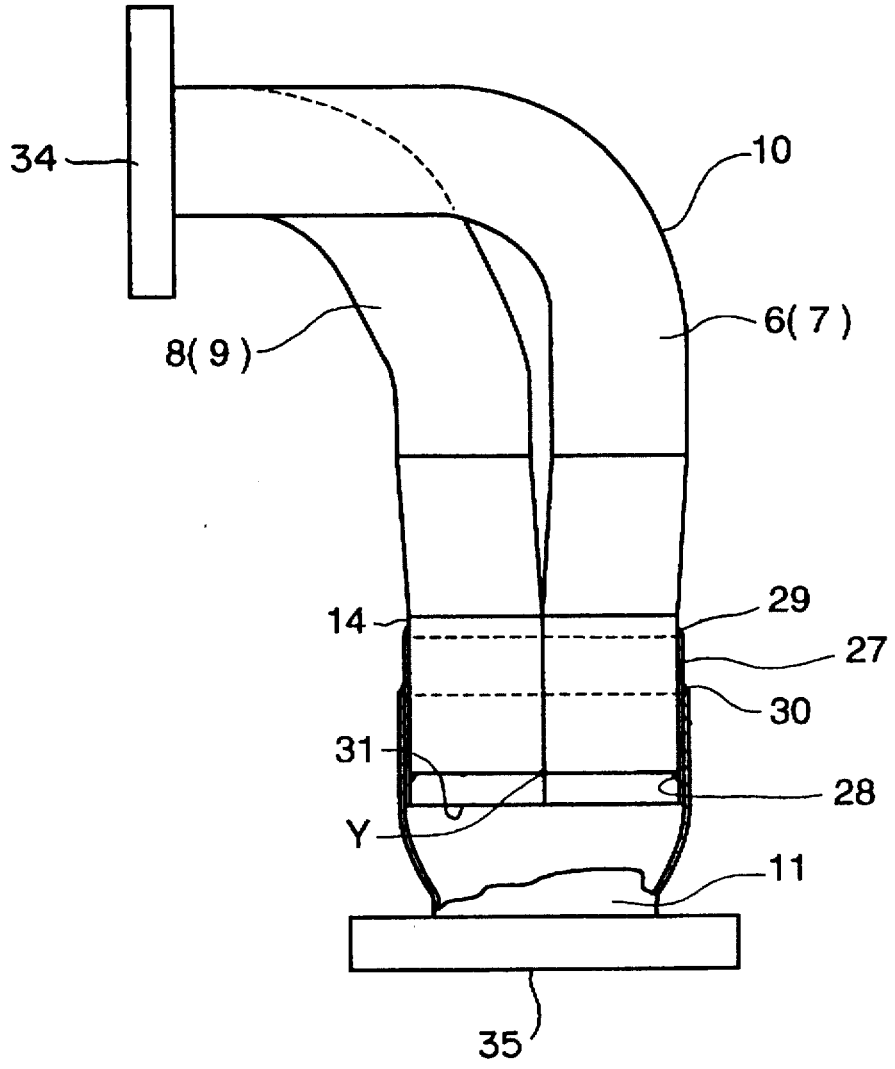
FIG. 1 is a side elevational view of an exhaust manifold branch collecting portion structure according to a first embodiment of the present invention.

A first group includes the first embodiment of the present invention illustrated in FIG. 1, wherein an intermediate member is provided between a combined pipe portion and a collecting pipe so that a moment is distributed by the intermediate member.

Figure 2:
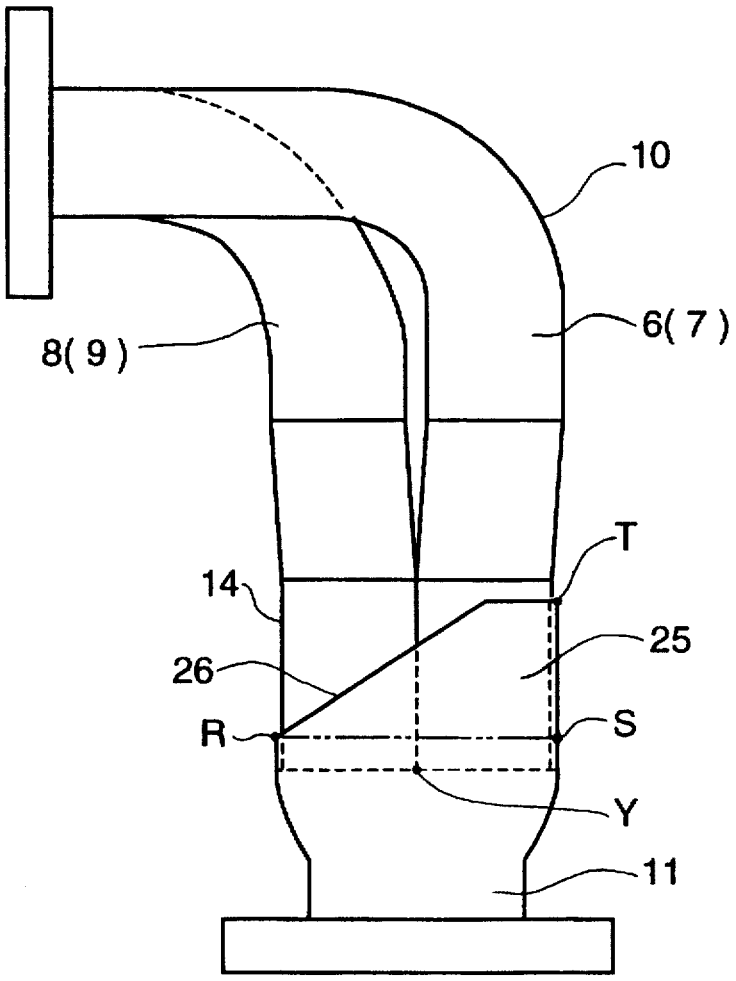
FIG. 2 is a side elevational view of an exhaust manifold branch collecting portion structure according to a second embodiment of the present invention.

A second group includes the second embodiment of the present invention illustrated in FIG. 2, wherein an upstream end of a collecting pipe is inclined so that a moment is distributed by the collecting pipe.

A third group includes the third, fourth, fifth, and sixth embodiments of the present invention illustrated in FIGS. 3–5, FIGS. 6 and 7, FIGS. 8 and 9, and FIGS. 10 and 11, respectively, wherein a weld line formed at the downstream ends of the partitioning walls of a combined pipe portion is partially offset in an axial direction of the combined pipe portion so that the point of maximum stress is radially shifted from the diametrical center of the combined pipe portion.

A fourth group includes the seventh, eighth, and ninth embodiments of the present invention illustrated in FIG. 12 and 13, FIG. 14 and 15, and FIG. 16 and 17, respectively, wherein a weld and the point of maximum stress are offset from each other in position.

Figure 18:
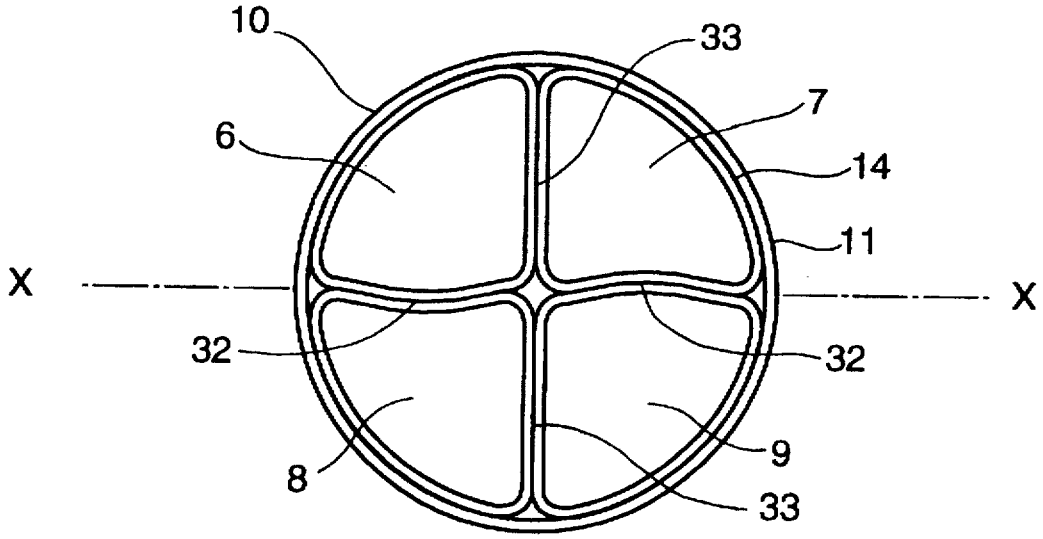
FIG. 18 is a cross-sectional view of an exhaust manifold branch collecting portion structure according to a tenth embodiment of the present invention (taken along line A—A of FIG. 41)
Figure 19:
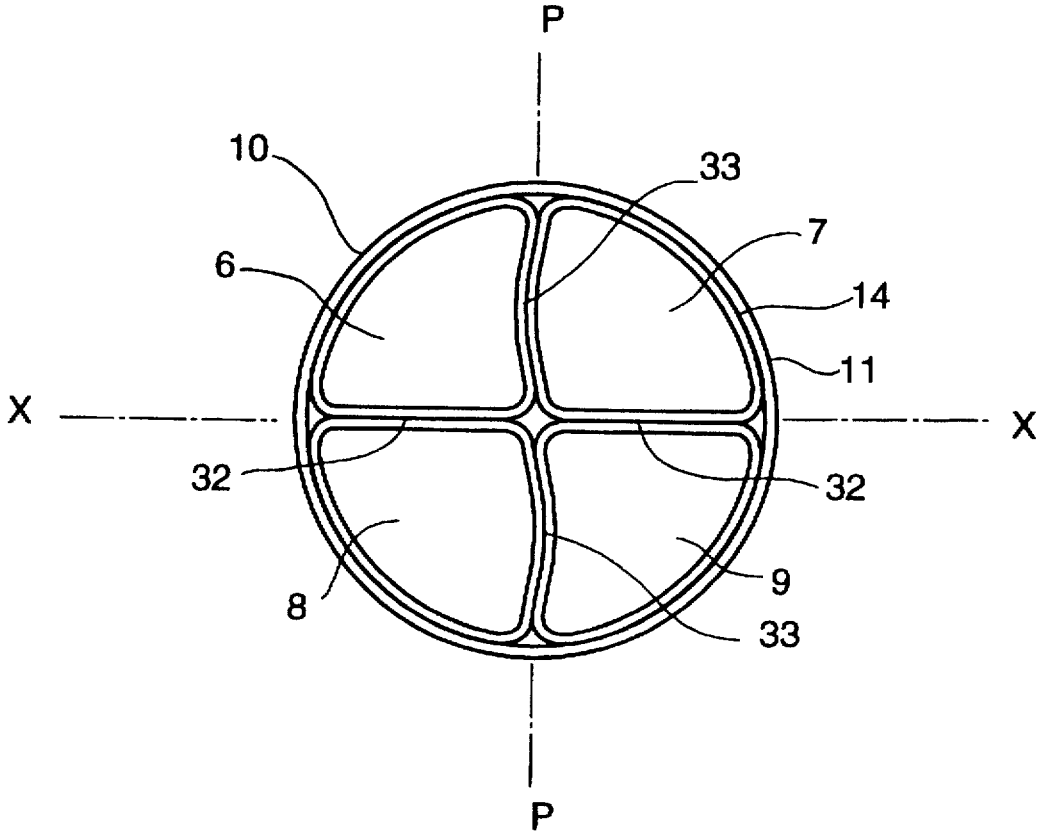
FIG. 19 is a cross-sectional view of an exhaust manifold branch collecting portion structure according to an eleventh embodiment of the present invention (taken along line C—C of FIG. 45)
Figure 20:
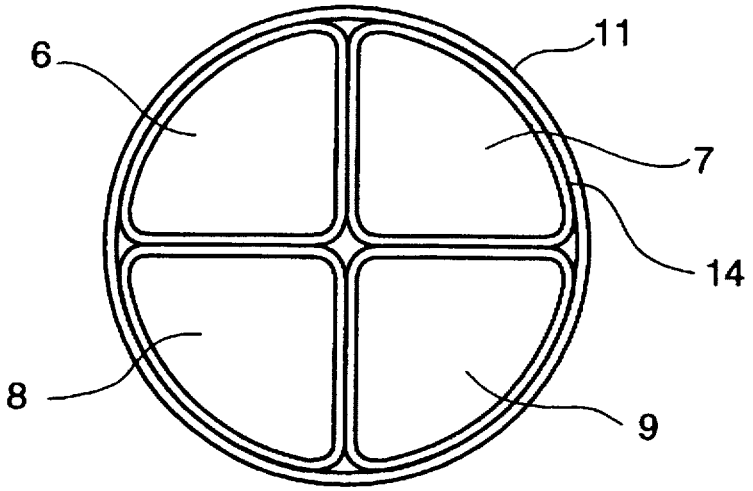
FIG. 20 is a cross-sectional view of an exhaust manifold branch collecting portion structure according to a twelfth embodiment of the present invention.
Figure 21:
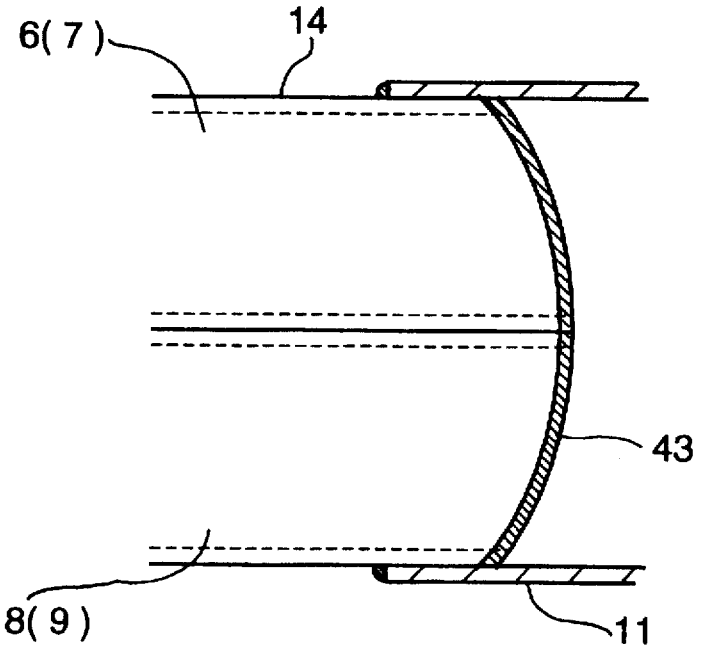
FIG. 21 is a side elevational view as viewed from a left side of the structure of FIG. 20.
Figure 22:
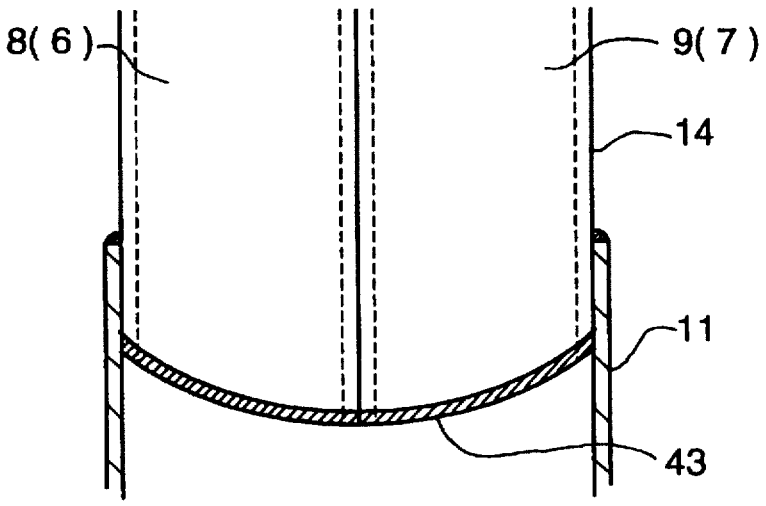
FIG. 22 is a front elevational view of the structure of FIG. 20.
Figure 23:
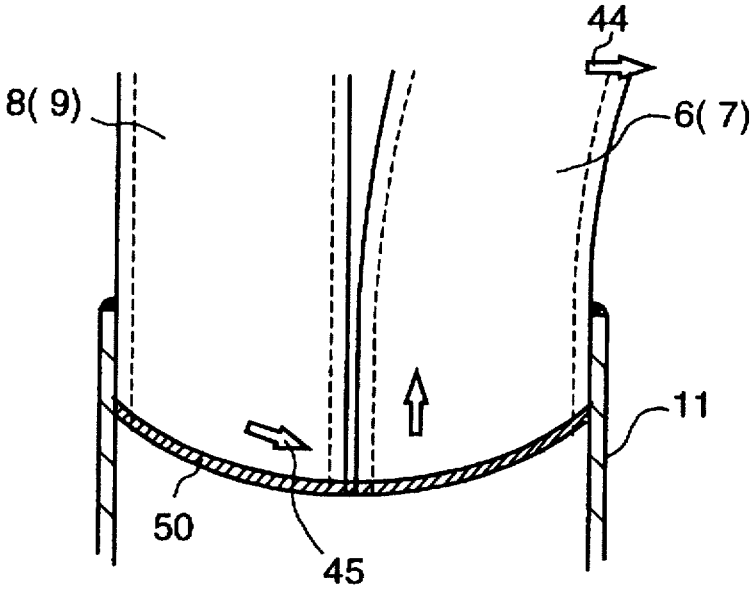
FIG. 23 is a schematic cross-sectional view of the structure of FIG. 21 illustrating a direction of a force caused in the structure when a thermal expansion difference is caused between long ports and short ports of the structure.

A fifth group includes the tenth and eleventh embodiments of the present invention illustrated in FIG. 18 and FIG. 19, respectively, wherein only one of the crossing partitioning walls of a combined pipe portion is curved.

A sixth group includes the twelfth embodiment of the present invention illustrated in FIGS. 20–24, wherein the downstream ends of the partitioning walls of the combined pipe portion are smoothly convex toward downstream.

A seventh group includes the thirteenth and fourteenth embodiments of the present invention illustrated in FIGS. 25 and 26 and FIGS. 27–30, respectively, wherein another weld is provided in a partitioning wall in addition to a weld formed at a downstream end of the partitioning wall.

An eighth group includes the fifteenth and sixteenth embodiments of the present invention illustrated in FIGS. 31–33 and FIGS. 34 and 35, respectively, wherein an intermediate member is provided, and the intermediate member and a pipe collecting member are welded over only a part of a circumference of the intermediate member.

Figure 44:
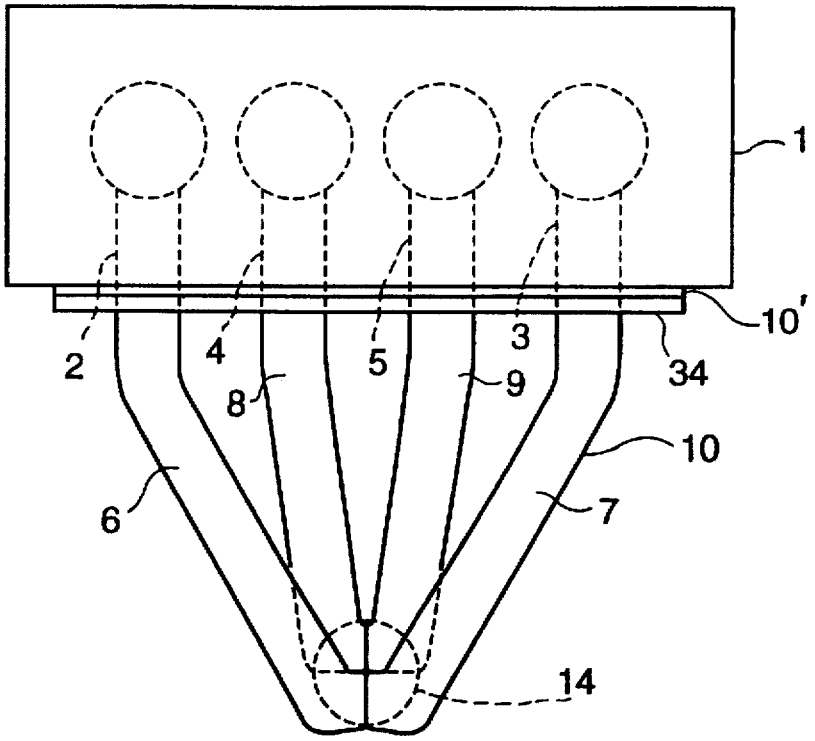
FIG. 44 is a plan view of an exhaust manifold of B-type.
Figure 45:
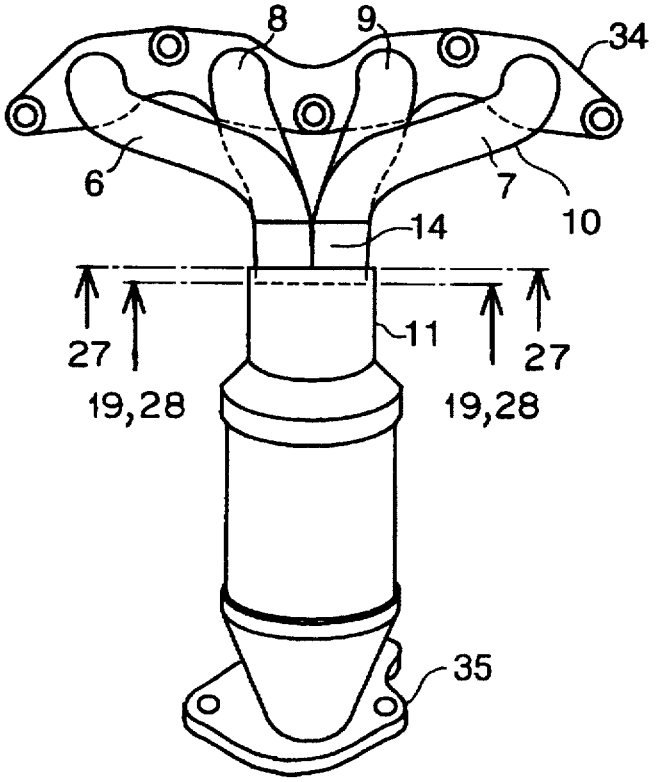
FIG. 45 is a front elevational view of the exhaust manifold of B-type.
Figure 46:
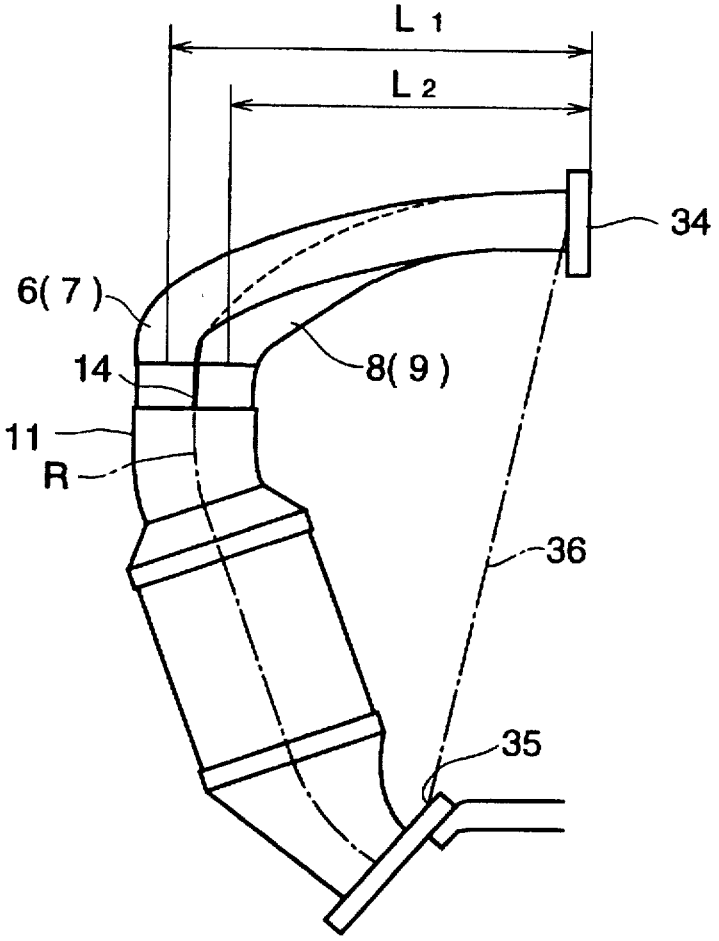
FIG. 46 is a side elevational view of the exhaust manifold of B-type.

First, structures and functions common to all of the embodiments of the present invention will be explained with reference to FIGS. 40–46. FIGS. 40–43 illustrate a A-type structure where a pipe collecting portion is located relatively close to an engine's cylinder head, and FIGS. 44–46 illustrate a B-type structure where the pipe collecting portion is located relatively far from an engine's cylinder head.

An exhaust manifold branch collecting portion structure according to any embodiment of the present invention includes an exhaust manifold 10 and a collecting pipe 11. The exhaust manifold 10 includes a plurality, equal in number to the number of cylinders, of (the same number as a number of cylinders) pipes 6, 7, 8, and 9 made from stainless steel and having downstream ends. Each of the downstream ends of the pipes 6, 7, 8, and 9 has a pie-shaped (i.e., fan-shaped) cross-section having sides and an arc. At the downstream ends of the pipes 6, 7, 8, and 9, adjacent pie-shaped cross-sections contact each other at their sides to form partitioning walls; these sides are welded together to form a combined pipe portion 14 having a circular cross-section. Then, at least a downstream end of the combined pipe portion 14 is inserted into an upstream end of the collecting pipe 11 and the combined pipe portion 14 is directly or indirectly fixed to the collecting pipe 11. In a case where the combined pipe portion 14 is directly welded to the collecting pipe 11, an upstream end of the collecting pipe 11 is welded to the side surface of the combined pipe portion 14. In a case where the combined pipe portion 14 is indirectly fixed to the collecting pipe 11, the combined pipe portion 14 is fixed to the collecting pipe 11 via an intermediate member as will be illustrated in a first, fifteenth, and sixteenth embodiments of the present invention.

The exhaust manifold 10 is coupled to a cylinder head 1 of an internal combustion engine via a gasket 10'. The cylinder head 1 has a longitudinal direction and includes exhaust ports communicating with No. 1 to No. 4 cylinders, respectively, which are arranged in series in the longitudinal direction of the cylinder head. The pipes 6 and 7 connected to exhaust ports 2 and 3, respectively, which communicate with No. 1 and No. 4 cylinders, respectively, have vertically curved portions spaced by distance L1 from a side surface of the cylinder head 1 in a direction perpendicular to the longitudinal direction of the cylinder head 1. The pipes 8 and 9 connected to exhaust ports 4 and 5, respectively, which communicate with No. 2 and No. 3 cylinders, respectively, have vertically curved portions spaced by distance L2 smaller than L1 from the side surface of the cylinder head 1 in the direction perpendicular to the longitudinal direction of the cylinder head 1.

Figure 47:
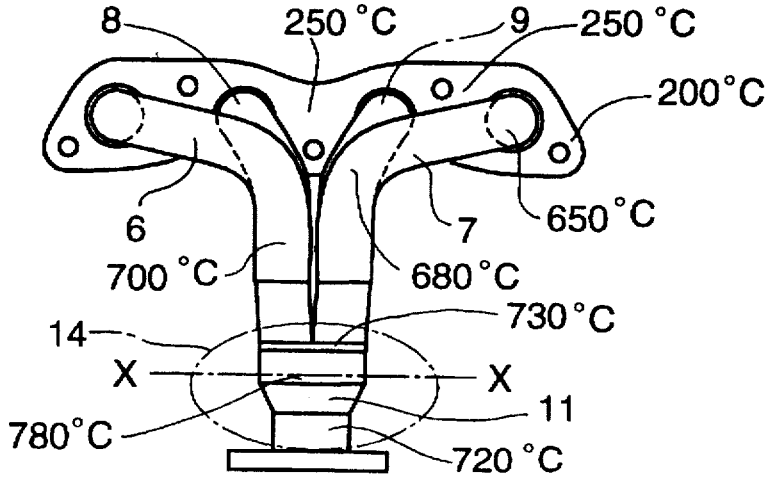
FIG. 47 is a front elevational view of the exhaust manifold of FIG. 41 illustrating a temperature distribution.

During engine operation, a thermal expansion occurs between the pipes 6 and 7 and the pipes 8 and 9 to generate a moment 12 about X—X axis (an axis extending in a direction parallel to the longitudinal direction of the cylinder head 1) of the combined pipe portion 14. This moment 12 causes thermal stresses in a weld line extending in the X—X direction at a downstream end of the pipe combined portion 14. Weld lines cross at point Y (a diametrical center). As illustrated in FIG. 47, which shows a temperature distribution, the temperature at point Y is high in comparison to other portions. Accordingly, structural reliability is critical at the weld lines, especially, at point Y.

Structures and functions unique to each embodiment of the present invention will now be explained.

With a first embodiment of the present invention, as illustrated in FIG. 1, the exhaust manifold branch collecting portion structure further includes a cylindrical intermediate member 27. The intermediate member 27 receives therein at least the downstream end of the combined pipe portion 14. The combined pipe portion 14 and the intermediate member 27 are welded to each other both at an upstream end of the intermediate member (as shown by a weld 29) and at a periphery of the downstream end of the combined pipe portion 14 (as shown by a weld 28). A downstream end of the intermediate member 27 is inserted into an upstream end of the collecting pipe 11. The intermediate member 27 is welded to the collecting pipe 11 at the upstream end of the collecting pipe 11 (as shown by a weld 30). Each of the welds 28 and 29 extends over the entire circumference of the intermediate member 27, and the weld 30 extends over the entire circumference of the collecting pipe 11.

In the first embodiment of the present invention, because the downstream end of the intermediate member 27 is not throttled in cross-section, the circumferential periphery of the downstream end of the combined pipe portion 14 can be easily welded to an inside surface of the intermediate member by inserting a welding torch through a downstream opening of the intermediate member 27. As a result, the combined pipe portion 14 can be welded to the intermediate member 27 at two positions, i.e., welds 28 and 29, so that the moment 12 acting on the combined pipe portion 14 can be distributed by the intermediate member 27 and the thermal stress caused at point Y of the pipe combined portion 14 can be decreased. Further, because the intermediate member 27 is welded to the collecting pipe 11 at the weld 30 at the upstream end of the collecting pipe 11 which is located axially between the welds 28 and 29, the stiffness of the intermediate member 27 is increased; accordingly, the thermal stress at point Y is further decreased. At a stage when the combined pipe portion 14 has been welded to the intermediate member 27, detecting the seal between the subassembly of the combined pipe portion 14 and the intermediate member 27 can be easily conducted by sealing the subassembly at a downstream end 31 of the intermediate member 27 and checking for leaks. Even if leaks are found during testing, the leaky portion can be easily repaired before the subassembly is welded to the collecting pipe 11.

With a second embodiment of the present invention, as illustrated in FIG. 2, the pipes 6, 7, 8, and 9 are grouped into a first group of pipes 6 and 7 and a second group of pipes 8 and 9. A horizontal distance L1 between a vertically curved portion of pipe and the cylinder head 1, of the first group of pipes 6 and 7 is greater than a horizontal distance L2 between a vertically curved portion of pipe and the cylinder head, of the second group of pipes 8 and 9. The collecting pipe 11 is extended upstream so that an upstream edge 26 (RT in FIG. 2) of the extended portion 25 is inclined from a line (RS in FIG. 2) perpendicular to an axial direction of the combined pipe portion 14. More particularly, axial distance of the upstream end 26 of the collecting pipe 11 from the downstream end of the combined pipe portion 14 is greater at a portion of the collecting pipe contacting the first group of pipes 6 and 7 than at another portion of the collecting pipe contacting the second group of pipes 8 and 9.

In the second embodiment of the present invention, because the moment 12 acting on the combined pipe portion 14 is distributed by the extended portion 25 of the collecting pipe 11, thermal stresses acting on the weld, which is formed at the downstream end of a partitioning wall of the combined pipe portion and extending in a direction X—X to the longitudinal direction of the cylinder head 1, are decreased. Further, because the axial length of the extended portion 25 is small at the portion of the collecting pipe that contacts the second group of pipes 8 and 9, the weight of the collecting pipe 11 is minimized.

Figure 3:
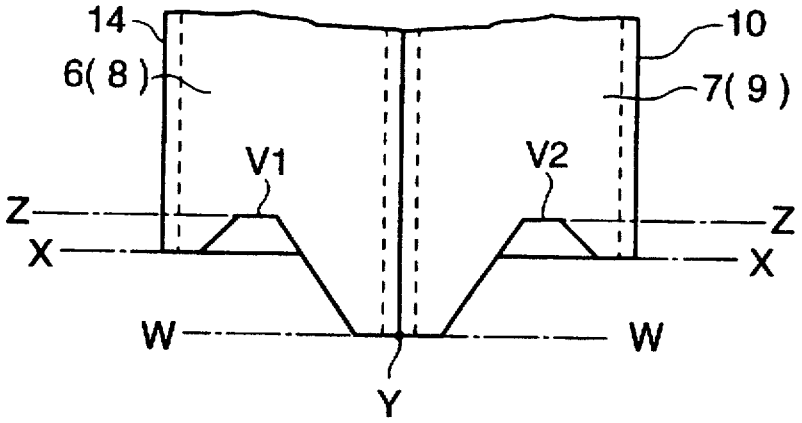
FIG. 3 is a front elevational view of an exhaust manifold branch collecting portion structure according to a third embodiment of the present invention.
Figure 4:
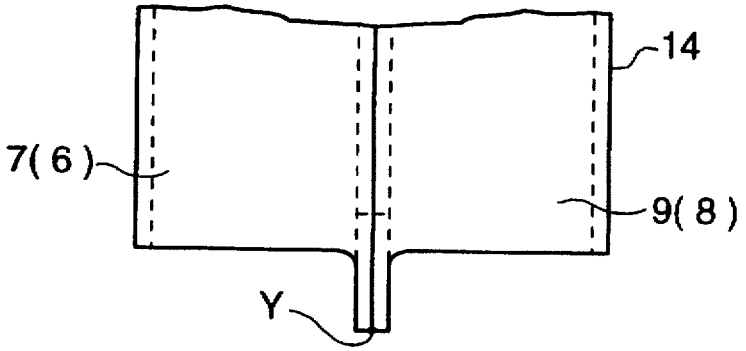
FIG. 4 is a side elevational view as viewed from a right side of the structure of FIG. 3.
Figure 5:
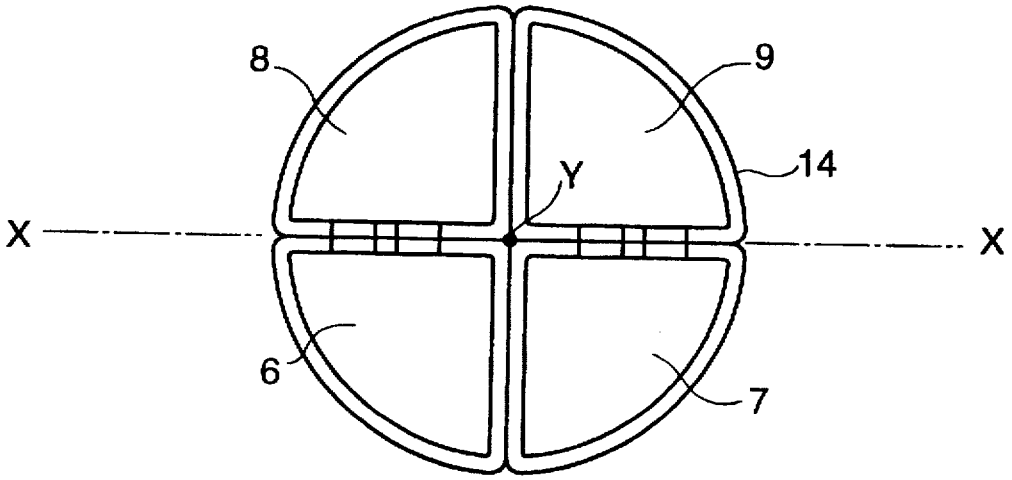
FIG. 5 is a plan view of the structure of FIG. 3.

With a third embodiment of the present invention, as illustrated in FIGS. 3–5, a weld line extending in direction X—X parallel to the longitudinal direction of the cylinder head, among weld lines formed at downstream ends of partitioning walls of the combined pipe portion 14 has a portion zigzagged from a remaining portion of the weld line in the axial direction of the combined pipe portion 14. The weld line extending in direction X—X has portions V1 and V2 receding upstream from the diametrical center point Y. More particularly, the weld line extends substantially downstream at line W—W (a diametrically central portion) including point Y, recedes at line Z—Z including portions V1 and V2 (radially intermediate portions located on opposite sides of the diametrically central portion), and returns to an axially intermediate position between line W—W and line Z—Z. Another weld line extending in a direction perpendicular to direction X—X is not zigzagged in the axial direction of the combined pipe portion 14 except where it crosses with the weld line extending in direction X—X.

In the third embodiment of the present invention, the axis of the moment acting on the combined pipe portion 14 is transformed from X—X exclusively to X—X, Z—Z, and W—W. Most notably, the maximum moment acts on the axis Z—Z, so that the point of maximum thermal stress shifts from point Y to portions V1 and V2 in axis Z—Z. Since the temperature at portions V1 and V2 is lower than at point Y, portions V1 and V2 can bear more moment than point Y. Point Y remains as the highest temperature point, and so the highest temperature point and the maximum point of stress generation are distinct. As a result, the overall structural reliability of the welds in the combined pipe portion 14 is improved.

Figure 6:
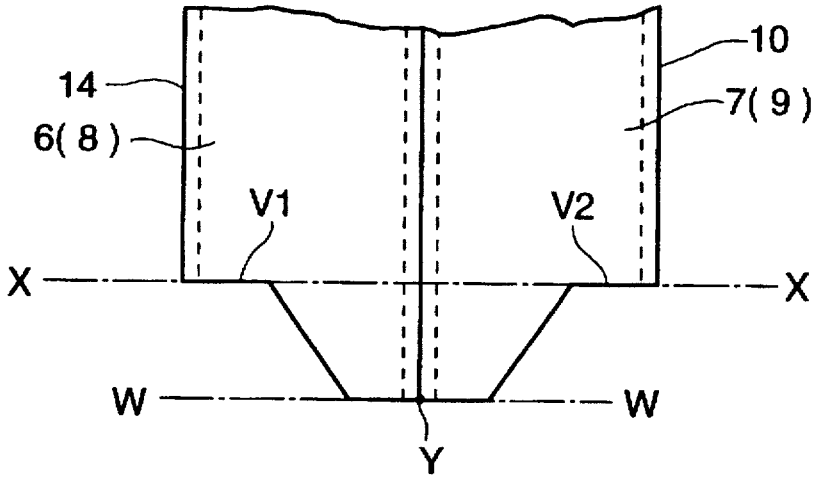
FIG. 6 is a front elevational view of an exhaust manifold branch collecting portion structure according to a fourth embodiment of the present invention.
Figure 7:
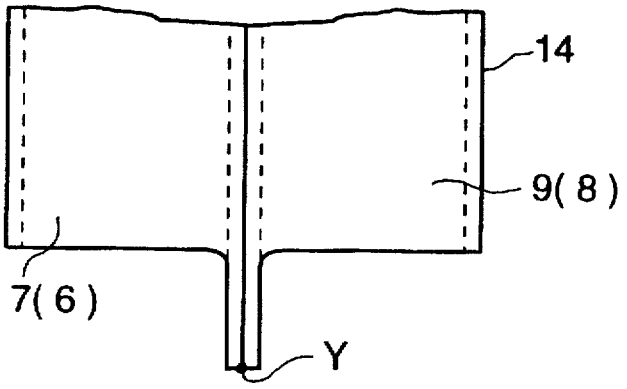
FIG. 7 is a side elevational view as viewed from a right side of the structure of FIG. 6.

With a fourth embodiment of the present invention, as illustrated in FIGS. 6 and 7, a weld line extending in direction X—X, parallel to the longitudinal direction of the cylinder head and formed at the downstream end of the partitioning wall of the combined pipe portion 14, is partially zigzagged in the axial direction of the combined pipe portion 14. The weld line extending in direction X—X has portions V1 and V2 receding upstream from diametrical center Y. More particularly, the weld line extends substantially downstream at line W—W (a diametrically central portion) including point Y, recedes at line X—X including portions V1 and V2 (diametrically outer portions located on opposite sides of the diametrically central portion). Another weld line extending in a direction perpendicular to direction X—X is not zigzagged in the axial direction of the combined pipe portion 14 except the crossing with the weld line extending in X—X direction.

In the fourth embodiment of the present invention, the same function as that of the third embodiment of the present invention is performed.

Figure 8:
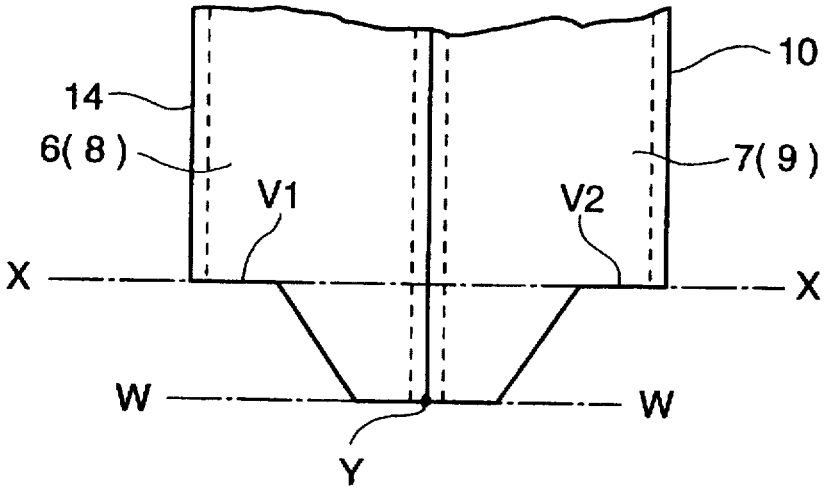
FIG. 8 is a front elevational view of an exhaust manifold branch collecting portion structure according to a fifth embodiment of the present invention.
Figure 9:
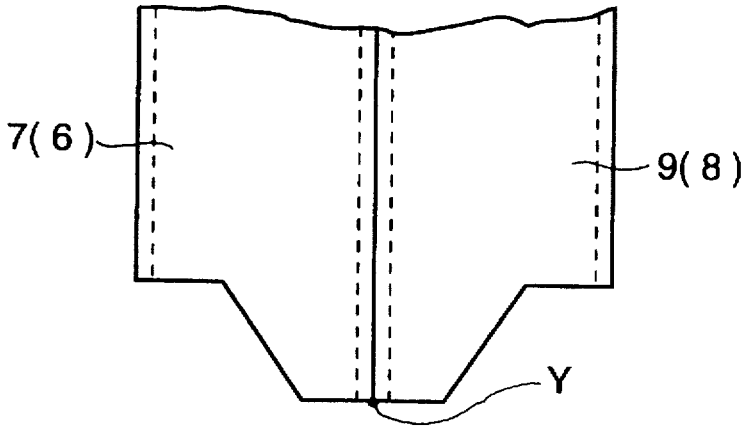
FIG. 9 is a side elevational view as viewed from a right side of the structure of FIG. 8.

With a fifth embodiment of the present invention, as illustrated in FIGS. 8 and 9, each of a first weld line extending in direction X—X parallel to the longitudinal direction of the cylinder head and a second weld line extending perpendicularly to direction X—X, formed at the downstream ends of the partitioning walls of the combined pipe portion 14, is partially zigzagged in the axial direction of the combined pipe portion 14. The first weld line has portions V1 and V2 receding toward diametrical center Y. More particularly, the first weld line extends substantially downstream at line W—W (a diametrical central portion) including point Y, and recedes at line X—X including portions V1 and V2 (diametrically outer portions located on opposite sides of the diametrically central portion). The second weld line has the same shape as that of the first weld line.

In the fifth embodiment of the present invention, the same function as that of the third embodiment of the present invention is performed.

Figure 10:
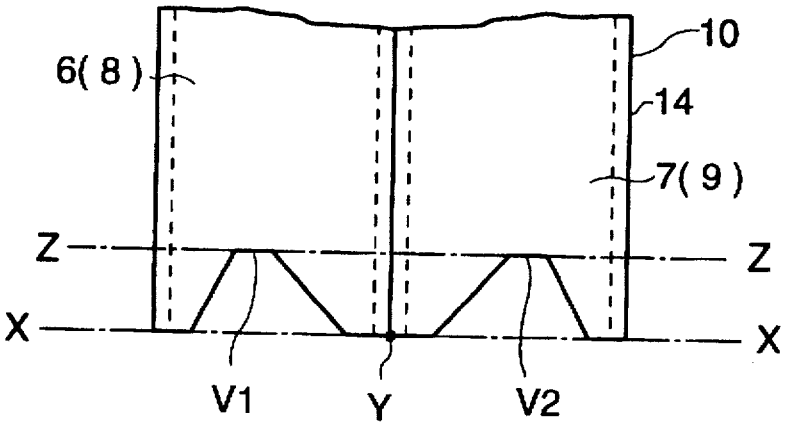
FIG. 10 is a front elevational view of an exhaust manifold branch collecting portion structure according to a sixth embodiment of the present invention.
Figure 11:
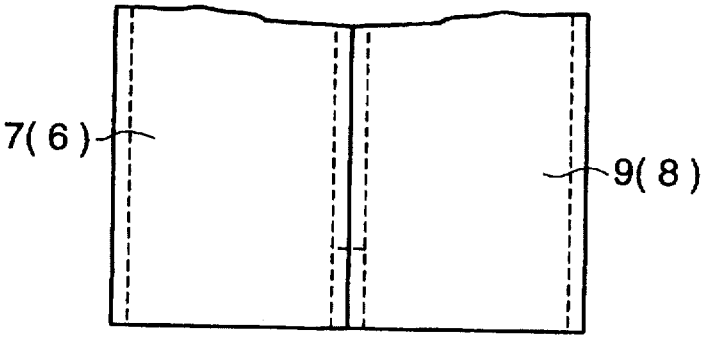
FIG. 11 is a side elevational view as viewed from a right side of the structure of FIG. 10.

With a sixth embodiment of the present invention, as illustrated in FIGS. 10 and 11, a weld line extending in direction X—X parallel to the longitudinal direction of the cylinder head and formed at the downstream end of the partitioning wall of the combined pipe portion 14 is partially zigzagged in the axial direction of the combined pipe portion 14. The weld line extending in direction X—X has portions receding upstream from the diametrical center Y. More particularly, the weld line extends substantially downstream at line X—X (a diametrically central portion) including point Y, recedes at line Z—Z including portions V1 and V2 (radially intermediate portions located on opposite sides of the diametrical central portion), and axially returns to line X—X at diametrically outer portions. Another weld line extending in a direction perpendicular to direction X—X is not zigzagged in the axial direction of the combined pipe portion 14 except the crossing with the weld line extending in X—X direction.

In the sixth embodiment of the present invention, the same function as that of the third embodiment of the present invention is performed.

Figure 12:
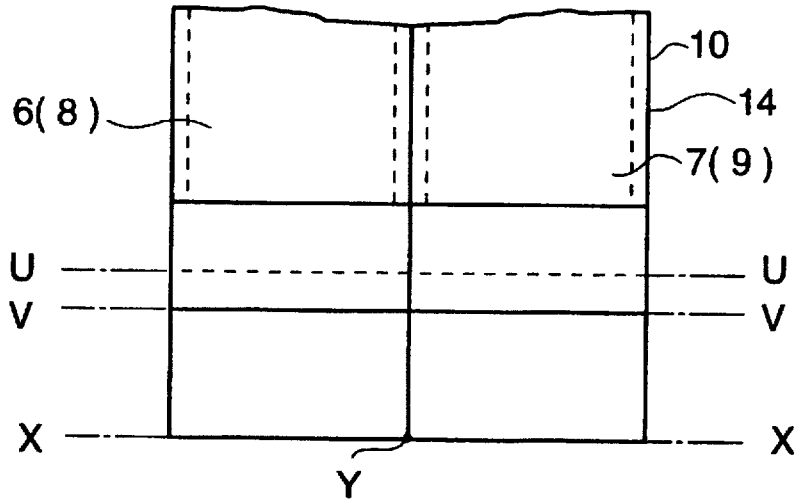
FIG. 12 is a front elevational view of an exhaust manifold branch collecting portion structure according to a seventh embodiment of the present invention.
Figure 13:
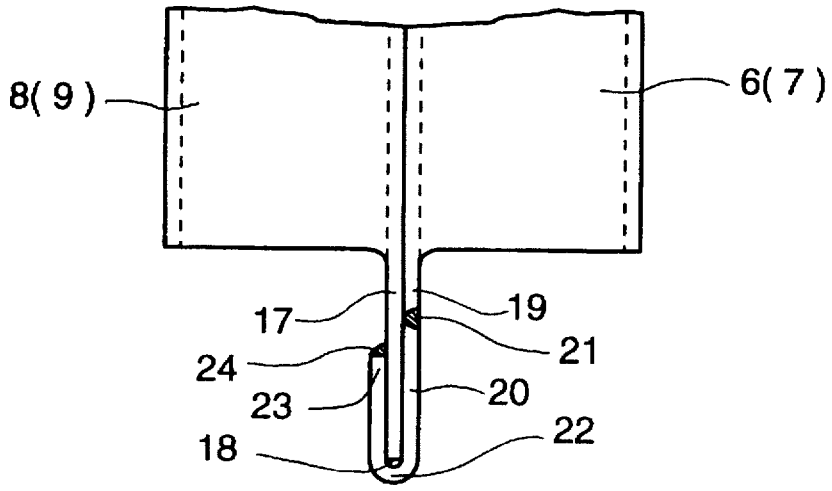
FIG. 13 is a side elevational view as viewed from a left side of the structure of FIG. 12.

With a seventh embodiment of the present invention, as illustrated in FIGS. 12 and 13, weld lines 21 and 24 formed in the combined pipe portion 14 and extending in a direction parallel to the longitudinal direction of the cylinder head are offset downstream in the axial direction of the combined pipe portion 14 from the downstream end surface of the combined pipe portion 14. More particularly, a partitioning wall parallel to the longitudinal direction of the cylinder head is extended downstream from the downstream end surface of the combined pipe portion 14 over an entire width of the partitioning wall by extending the sides of the pie-shaped cross-sections of the downstream ends of adjacent pipes included in the partitioning wall to form extended portions 17 and 19. Lengths of the extended portions 17 and 19 are distinct. The extended portions (longer ones) 17 of the sides of the pipes 8 and 9 are cut at ends 18 thereof. The extended portions (shorter ones) 19 of the pipes 6 and 7 are connected by an extension plate 20 (by a weld 21) at one end of the extension plate 20. The extension plate 20 is folded back at a portion 22 so as to wrap the ends 18. The other end 23 of the extension plate 20 is welded to the extended portions 17 of the pipes 8 and 9 (by a weld 24).

In the seventh embodiment of the present invention, a maximum thermal expansion stress due to a moment occurs at axis X—X. However, the weld lines 21 and 24 are positioned on axis U—U and axis V—V, respectively, which are discretely spaced from axis X—X. Therefore, the maximum stress yielding location and the weld lines do not coincide with each other, thereby increasing the structural reliability of the welds.

Figure 14:
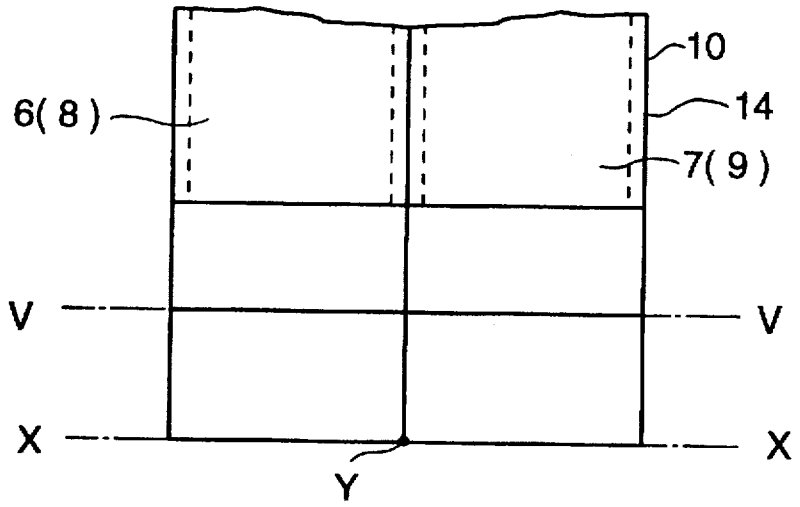
FIG. 14 is a front elevational view of an exhaust manifold branch collecting portion structure according to an eighth embodiment of the present invention.
Figure 15:
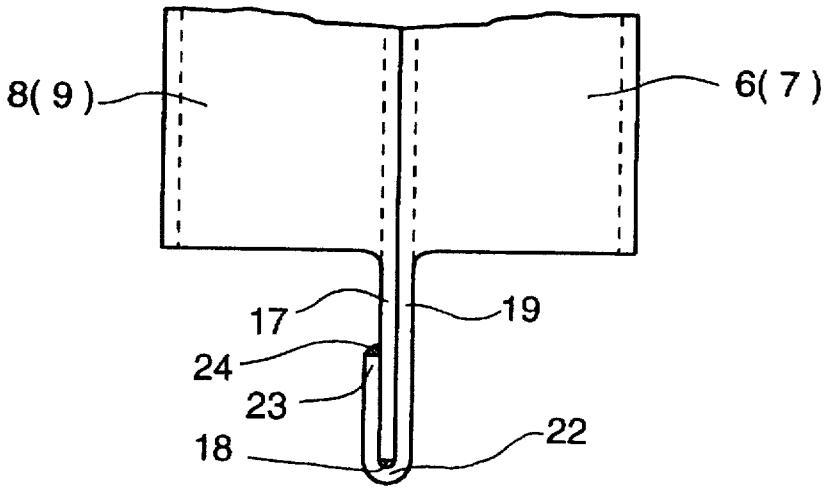
FIG. 15 is a side elevational view as viewed from a left side of the structure of FIG. 14.

With an eighth embodiment of the present invention, as illustrated in FIGS. 14 and 15, a weld line 24 of the combined pipe portion 14 parallel to the longitudinal direction of the cylinder head is offset downstream in the axial direction of the combined pipe portion 14 from the downstream end surface of the combined pipe portion 14. More particularly, a partitioning wall parallel to the longitudinal direction of the cylinder head is extended downstream from the downstream end surface of the combined pipe portion 14 over an entire width of the partitioning wall by extending sides of the pie-shaped cross-sections of the downstream ends of adjacent pipes included in the partitioning wall to form extended portions 17 and 19. Lengths of the extended portions 17 and 19 are different. The extended portions (shorter ones) 17 of the sides of the pipes 8 and 9 are cut at ends 18 thereof. The extended portions (longer ones) 19 of the pipes 6 and 7 are folded back at a portion 22 so as to wrap the ends 18, and are welded to the extended portions 17 of the pipes 8 and 9 by weld 24.

In the eighth embodiment of the present invention, since the weld line on axis V—V and the maximum stress yielding location at X—X are axially spaced from each other, structural reliability of the weld 24 is improved.

Figure 16:
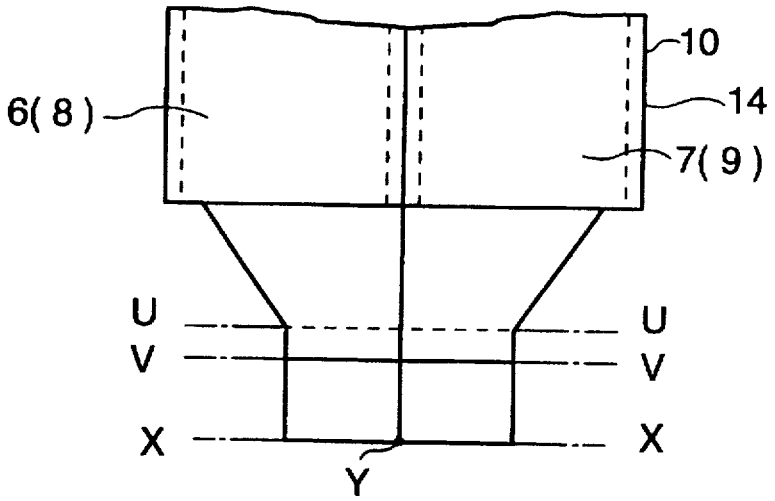
FIG. 16 is a front elevational view of an exhaust manifold branch collecting portion structure according to a ninth embodiment of the present invention.
Figure 17:
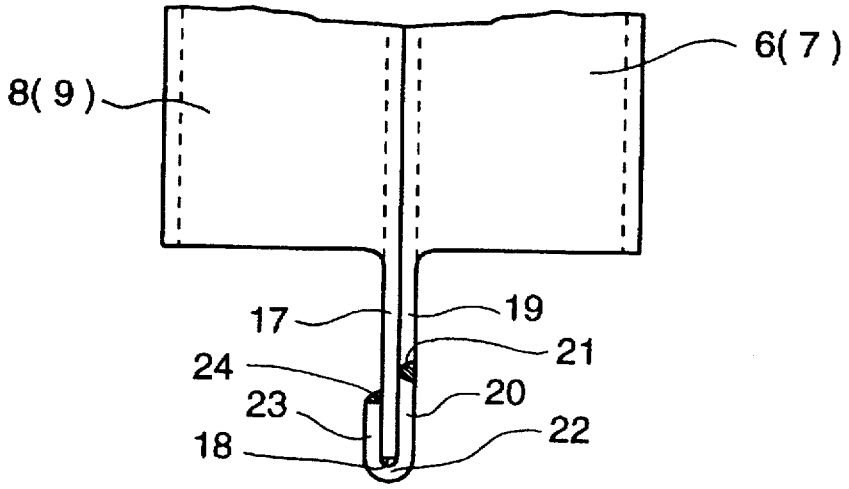
FIG. 17 is a side elevational view as viewed from a left side of the structure of FIG. 16.

With a ninth embodiment of the present invention, as illustrated in FIGS. 16 and 17, weld lines 21 and 24 formed in the combined pipe portion 14 and extending in a direction parallel to the longitudinal direction of the cylinder head are offset downstream in the axial direction of the combined pipe portion 14 from the downstream end surface of the combined pipe portion 14. More particularly, a partitioning wall parallel to the longitudinal direction of the cylinder head is extended downstream from the downstream end surface of the combined pipe portion 14 over a part of the width of the partitioning wall by extending the sides of the pie-shaped cross-sections of the downstream ends of adjacent pipes included in the partitioning wall to form extended portions 17 and 19. The widths of the extended portions 17 and 19 are reduced from the downstream end surface of the combined pipe portion 14 to line U—U and are constant at a downstream of line U—U. Lengths of the extended portions 17 and 19 are different. The extended portions (longer ones) 17 of the sides of the pipes 8 and 9 are cut at ends 18 thereof. The extended portions (shorter ones) 19 of the pipes 6 and 7 are connected by an extension plate 20 (by a weld 21) at one end of the extension plate 20. The extension plate 20 is folded back at a portion 22 so as to wrap the ends 18. The other end 23 of the extension plate 20 is welded, by weld 24, to the extended portions 17 of the pipes 8 and 9.

In the ninth embodiment of the present invention, a maximum stress due to a moment induced by a thermal expansion difference is caused at axis X—X. However, the weld lines 21 and 24 are positioned on axis U—U and axis V—V, respectively, which are spaced from axis X—X. Therefore, the maximum stress yielding position and the weld lines are not coincident with each and the structural reliability of the welds is improved.

A tenth embodiment of the present invention is applied to an A-type structure where an exhaust manifold branch collecting portion structure is supported by the cylinder head 1 at an upstream support point 34 located at an upstream end of the exhaust manifold 10 and at a downstream support point 35 spaced from the upstream support point 34, and a distance (an average distance (L1+L2)/2 with respect to the pipes 6, 7, 8, 9) between a vertically curved portion of the pipes 6, 7, 8, and 9 and the cylinder head 1 is equal to or smaller than a distance between the downstream support point 35 and the cylinder head 1.

In the tenth embodiment of the present invention, as illustrated in FIG. 18 (a cross-section taken along line A—A of FIG. 41), the exhaust manifold 10 includes four pipes 6, 7, 8, and 9, and the combined pipe portion 14 includes two partitioning walls 32 and 33 crossing at a substantially right angle to each other. One of the partitioning walls 32 and 33 extending in direction X—X parallel to the longitudinal direction of the cylinder head 1 is a curved wall, and the other of the partitioning walls 32 and 33 is a diametrically extending straight wall.

Figure 36:
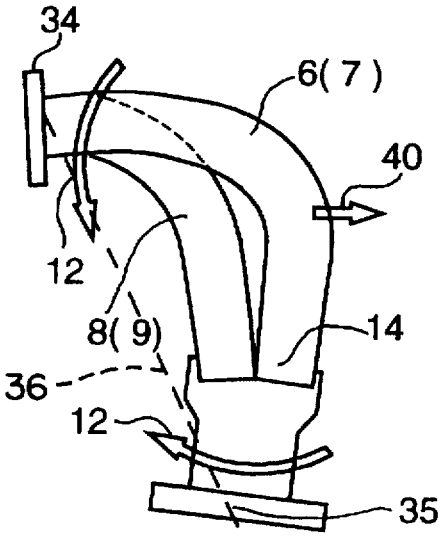
FIG. 36 is a side elevational view of an exhaust manifold of A-type, illustrating a force, a moment, and a deformation caused in the exhaust manifold.
Figure 37:
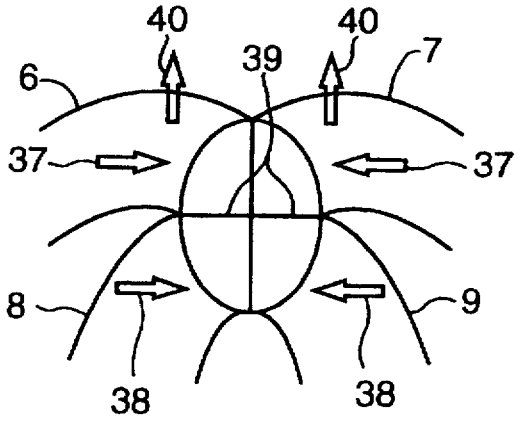
FIG. 37 is a plan view of the exhaust manifold of A-type, illustrating a force and a deformation caused in the exhaust manifold.

A thermal fatigue crack generation mechanism in A-type structure shown in FIGS. 40–43 will be illustrated with reference to FIGS. 36 and 37. Since the combined pipe portion 14 is located relatively close to the cylinder head (or a flange 34 at an exhaust manifold inlet) and far from a line 36 (see FIGS. 36 and 42) connecting the flange 34 and the second support point 35 in the A-type structure, the pipe 6 and the pipe 7 located on opposite sides of the combined pipe portion 14 are opposed to each other in a direction parallel to the longitudinal direction of the cylinder head, and the pipe 8 and the pipe 9 are opposed to each other in the direction parallel to the longitudinal direction of the cylinder head. When the pipes 6, 7, 8, and 9 thermally expand, forces 37 and 38 opposed to each other act on the combined pipe portion 14 so that the cross section of the combined pipe portion is deformed, as shown in FIG. 37, to be diametrically shortened in the direction parallel to the longitudinal direction of the cylinder head. As a result, a strain concentrates on a weld line 39 and a crack tends to initiate at the weld line 39. Further, a thermal expansion difference is caused between the longer pipes 6 and 7 and the shorter pipes 8 and 9 to generate a force 40, by which deformation of the cross-section of the combined pipe portion 14 is promoted.

In the tenth embodiment of the present invention, since the partitioning wall 32 extending in parallel with the forces 37 and 38 is curved, deformation is distributed to the entire diameter of the partitioning wall 32 so that crack generation at the center of the cross-section of the combined pipe portion is suppressed.

If both of partitioning walls crossing to each other were curved, the cross-sectional stiffness decreases and promotes the cross-sectional deformation shown in FIG. 37. As a result, a sufficient crack generation suppressing effect is not obtained. In the tenth embodiment of the present invention, since the wall 33 which is perpendicular to the curved wall 32 is straight, a deformation shown in FIG. 37 is not promoted, and sufficient crack generation suppression is obtained.

An eleventh embodiment of the present invention is applied to a B-type structure where an exhaust manifold branch collecting portion structure is supported by the cylinder head 1 at an upstream support point 34 located at an upstream end of the exhaust manifold 10 and at a downstream support point 35 spaced from the upstream support point 34, and a distance (an average distance (L1+L2)/2 with respect to the pipes 6, 7, 8, 9) between a vertically curved portion of the pipes 6, 7, 8, and 9 and the cylinder head 1 is greater than a distance between the downstream support point 35 and the cylinder head 1.

In the eleventh embodiment of the present invention, as illustrated in FIG. 19 (a cross section taken along line C—C of FIG. 45), the exhaust manifold 10 includes four pipes 6, 7, 8, and 9, and the combined pipe portion 14 includes two partitioning walls 32 and 33 crossing at a substantially right angle to each other. One of the partitioning walls 32 and 33 extending in direction P—P perpendicular to the longitudinal direction of the cylinder head 1 is a curved wall, and the other of the partitioning walls 32 and 33 is a diametrically extending straight wall.

Figure 38:
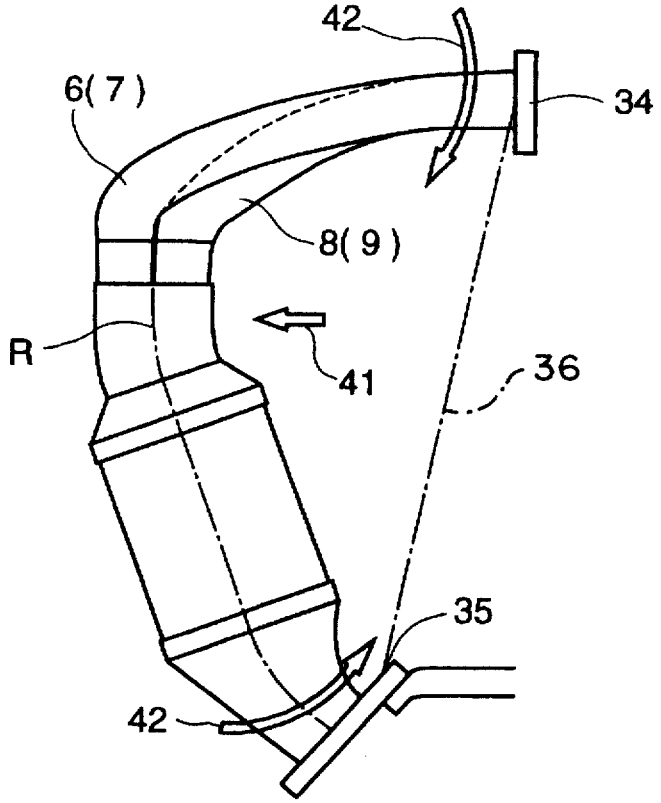
FIG. 38 is a side elevational view of an exhaust manifold of B-type, illustrating a force, a moment, and a deformation caused in the exhaust manifold.
Figure 39:
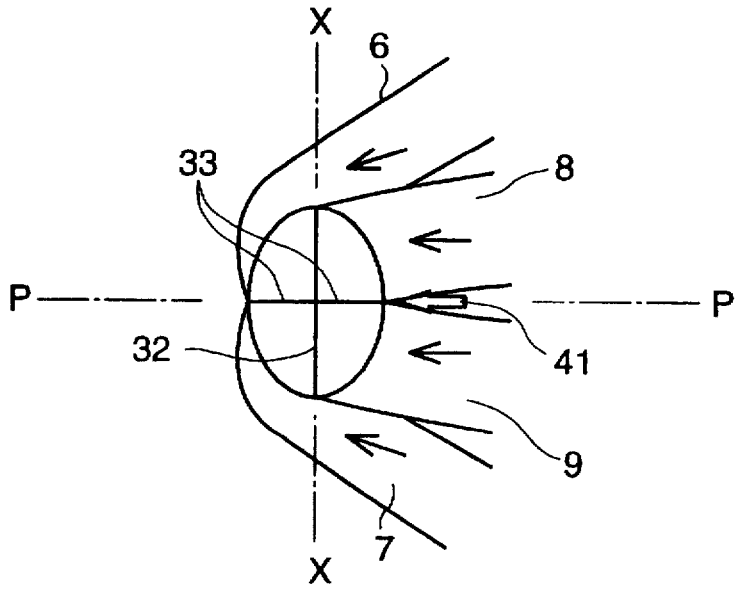
FIG. 39 is a plan view of the exhaust manifold of B-type, illustrating a force and a deformation caused in the exhaust manifold.
Figure 40:
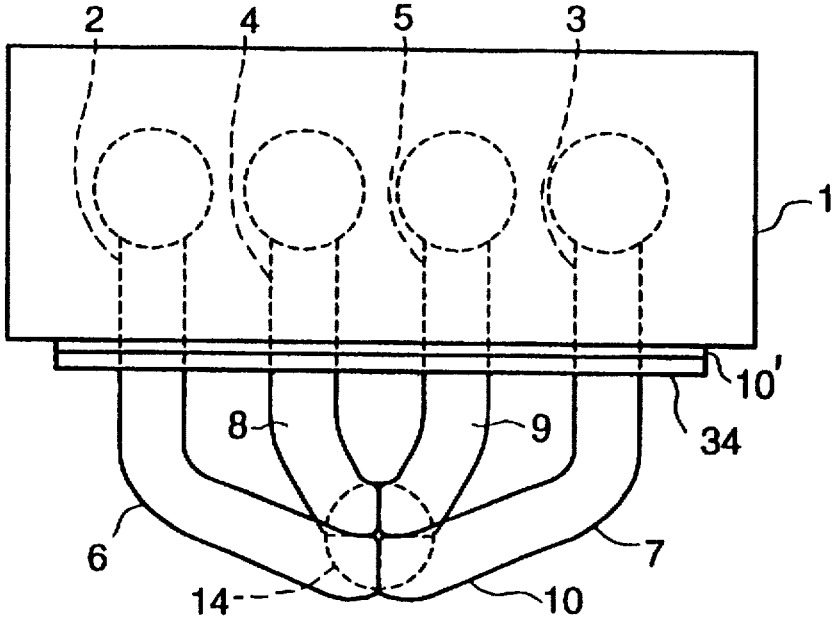
FIG. 40 is a plan view of the exhaust manifold of A-type.
Figure 41:
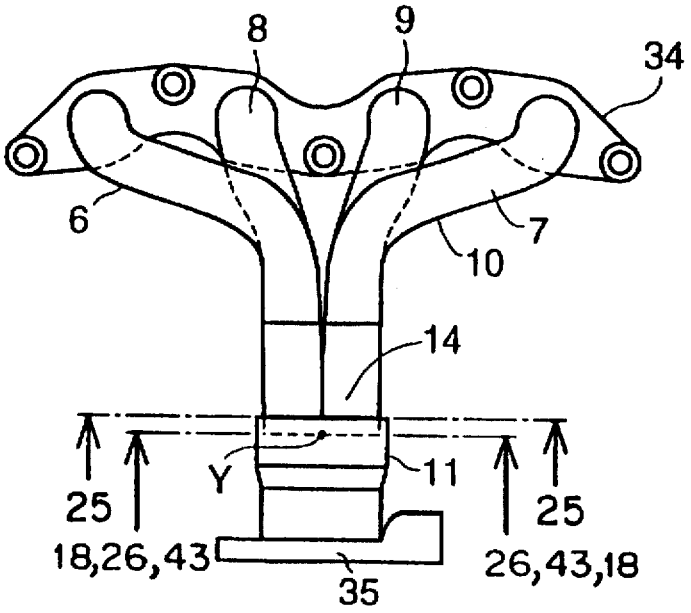
FIG. 41 is a front elevational view of the exhaust manifold of A-type.
Figure 42:
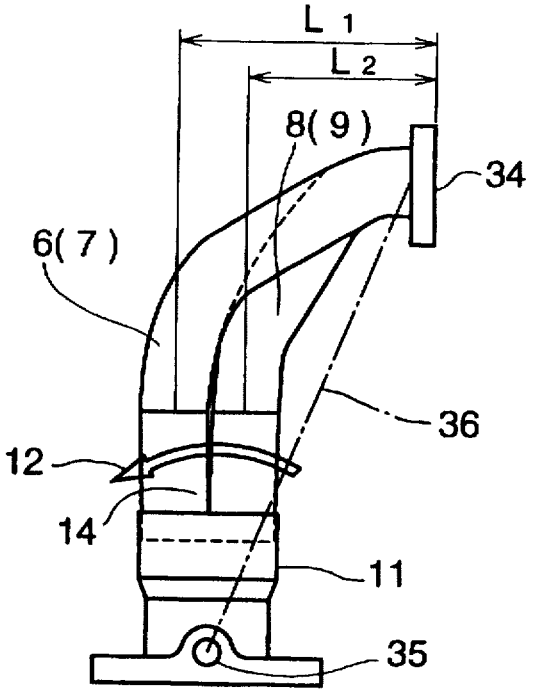
FIG. 42 is a side elevational view of the exhaust manifold of A-type.
Figure 43:
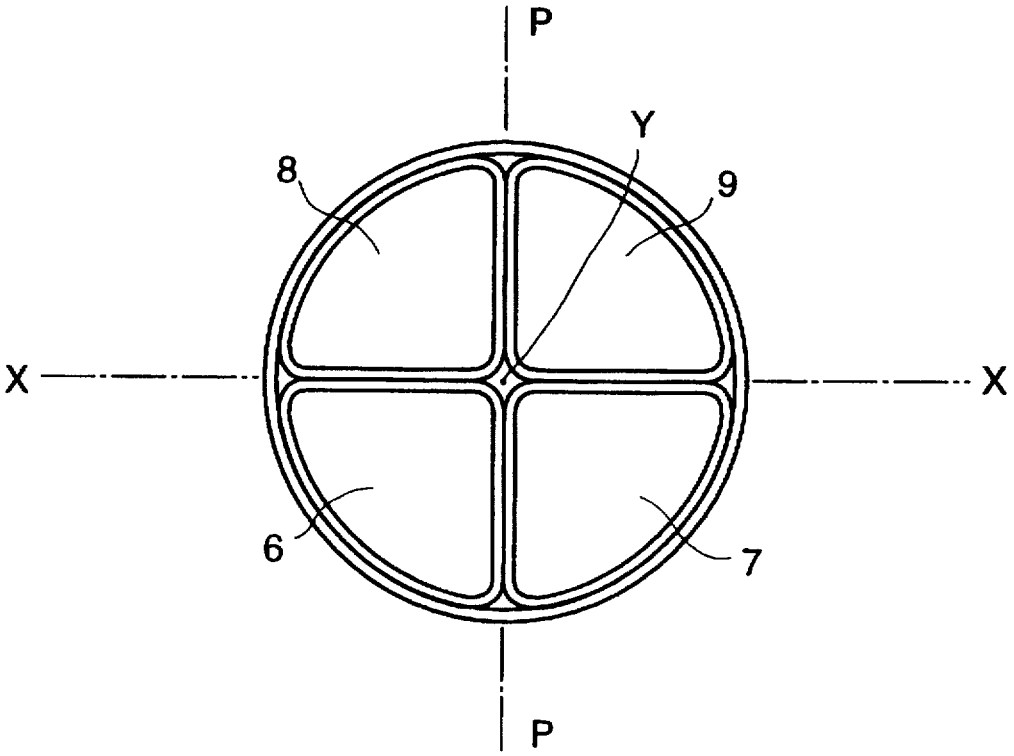
FIG. 43 is a cross-sectional view of a combined pipe portion of the exhaust manifold of A-type, taken along line A—A of FIG. 41.

A thermal fatigue crack generation mechanism in the B-type structure shown in FIGS. 44–46 will be illustrated with reference to FIGS. 38 and 39. Since the combined pipe portion 14 is located relatively far from the cylinder head 1 (or a flange 34 at an exhaust manifold inlet) and far from a line 36 (see FIGS. 38 and 46) connecting the flange 34 and the second support point 35 in the B-type structure, the pipe 6 and the pipe 7 located on opposite sides of the combined pipe portion 14 are not opposed to each other in a direction parallel to the longitudinal direction of the cylinder head, and the pipe 8 and the pipe 9 are not opposed to each other in the direction parallel to the longitudinal direction of the cylinder head. Therefore, a deformation of the combined pipe portion 14 as caused in the A-type structure is unlikely to be caused. Despite that, as illustrated in FIGS. 38 and 39, a moment 42 due to a thermal expansion force 41 which acts in a direction away from the cylinder head acts on the pipes 6, 7, 8, and 9, so that the pipe combined portion 14 tends to compress in direction P—P perpendicular to the longitudinal direction of the cylinder head 1. Therefore, in the B-type structure, the partitioning wall 33 extending perpendicularly to the longitudinal direction of the cylinder head 1 is a curved wall.

In the eleventh embodiment of the present invention, since the partitioning wall 33 extending in a direction P—P is curved, deformation is distributed to the entire diameter of the partitioning wall 33 so that generation of a crack at a center of the cross section of the combined pipe portion is suppressed.

If both of the partitioning walls crossing each other were curved, cross-sectional stiffness would be decreased to promote the cross-sectional deformation shown in FIG. 39. As a result, a sufficient crack generation suppressing effect is not obtained. In the eleventh embodiment of the present invention, since the wall 32 which is parallel to the curved wall 33 is straight, a deformation shown in FIG. 39 is not promoted; accordingly, a sufficient crack generation suppressing effect is obtained.

A twelfth embodiment of the present invention is applied to the A-type structure. With the twelfth embodiment of the present invention, as illustrated in FIGS. 20–24, the downstream ends of both of the partitioning walls 32 and 33 crossing to each other are smoothly curved in the axial direction of the combined pipe portion 14 so as to be convex in the downstream direction. The convex configurations 43 have no inflection point.

Figure 24:
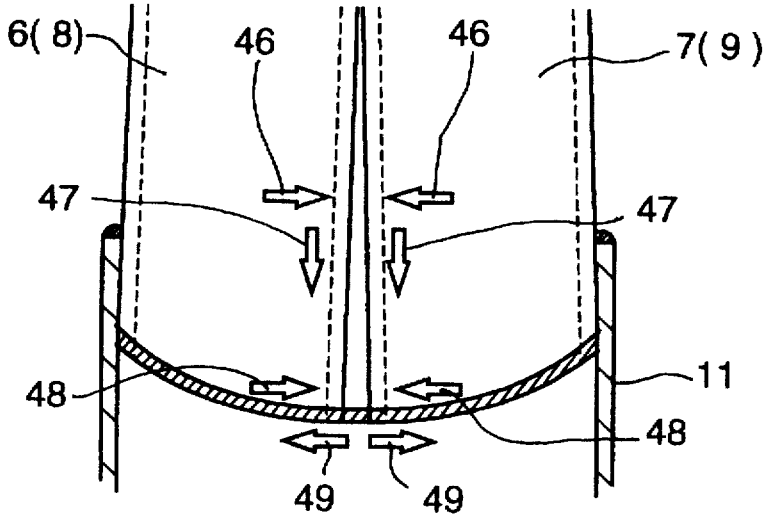
FIG. 24 is a schematic cross-sectional view of the structure of FIG. 22 illustrating a direction of a force caused in the structure when a force acts between opposed ports to compress a cross-section of the structure.

In the twelfth embodiment of the present invention, since the downstream ends of the partitioning walls have configurations 43 convex in the downstream direction when a force 44 due to a thermal expansion difference between the longer pipes 6 and 7 and the shorter pipes 8 and 9 acts on the pipes 6 and 7 in a direction away from the pipes 8 and 9, the convex portion 43 generates a force 45 to compensate a moment due to the force 44 and prevents a deformation of the cross-section of the combined pipe portion 14. Further, as illustrated in FIG. 24, the forces 46 acting between the opposed pipes 6 and 7 and between the opposed pipes 8 and 9 that compress the cross-section of the combined pipe portion 14 in the direction parallel to the cylinder head generate forces 47 pushing the combined pipe portion 14 downward, which in turn generate forces 49 acting in a direction away from a diametrical center of the combined pipe portion 14 at the downstream ends of the combined pipe portion 14. However, the convex configuration 43 causes forces 48 acting in a direction opposite to the direction of the forces 49, so that deformation of the cross-section of the combined pipe portion 14 is suppressed, and stresses and strains caused in the weld 50 are decreased. As a result, generation of a crack in the weld 50 is suppressed.

This convex configuration should not be applied to B-type structures, because the longer pipe deformation suppressing effect of A-type structures will promote deformation of the cross-section of the combined pipe portion 14 of the B-type structure to thereby promote crack generation in B-type structures.

Figure 25:
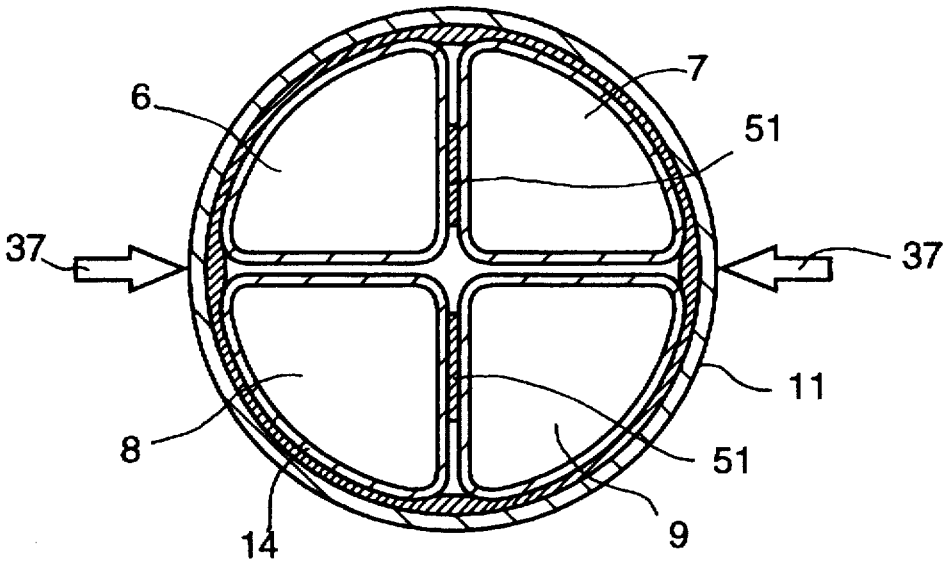
FIG. 25 is a cross-sectional view of an exhaust manifold branch collecting portion structure according to a thirteenth embodiment of the present invention (taken along line B—B of FIG. 41)
Figure 26:
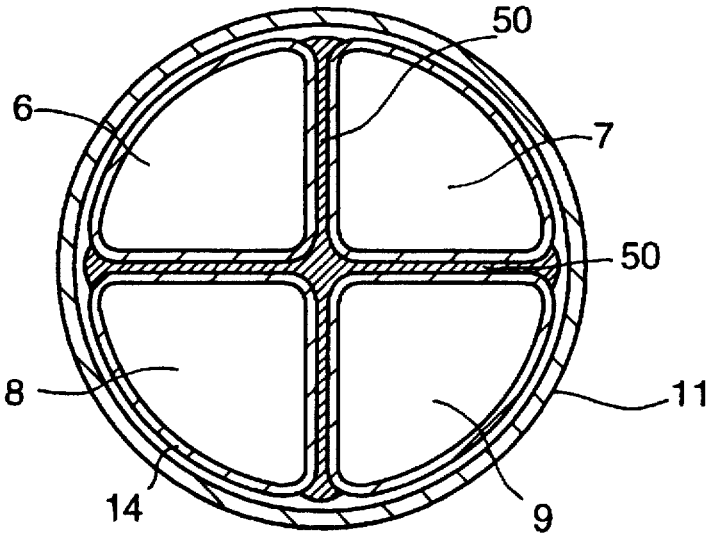
FIG. 26 is a cross-sectional view of the structure according to the thirteenth embodiment of the present invention (taken along line A—A of FIG. 41)

A thirteenth embodiment of the present invention is applied to the A-type structure. With the thirteenth embodiment of the present invention, as illustrated in FIG. 25 (a cross-section taken along line B—B of FIG. 41) and FIG. 26 (a cross section taken along line A—A of FIG. 41), the exhaust manifold 10 includes four pipes 6, 7, 8, and 9, and therefore, the combined pipe portion 14 includes two partitioning walls 32 and 33 that cross to each other. In one 33 of the partitioning walls 32 and 33 that extend perpendicularly to the longitudinal direction of the cylinder head, an additional weld 51 is spaced from the weld 50 formed at the downstream end of the partitioning wall 33. The additional weld 51 may be a spot weld or a seam weld.

In the thirteenth embodiment of the present invention, in the A-type structure, the opposed pipes 6 and 7 are connected at welds 50 and 51, and the opposed pipes 8 and 9 are connected at weld 50 and 51. As a result, the force transmitting between the pipes 6 and 7 and between the pipes 8 and 9 are distributed through two routes (i.e., a route through the weld 50 and a route through the weld 51) wherein a stress caused in the weld 50 is decreased, and a crack initiation at the weld 50 is unlikely to occur.

Figure 27:
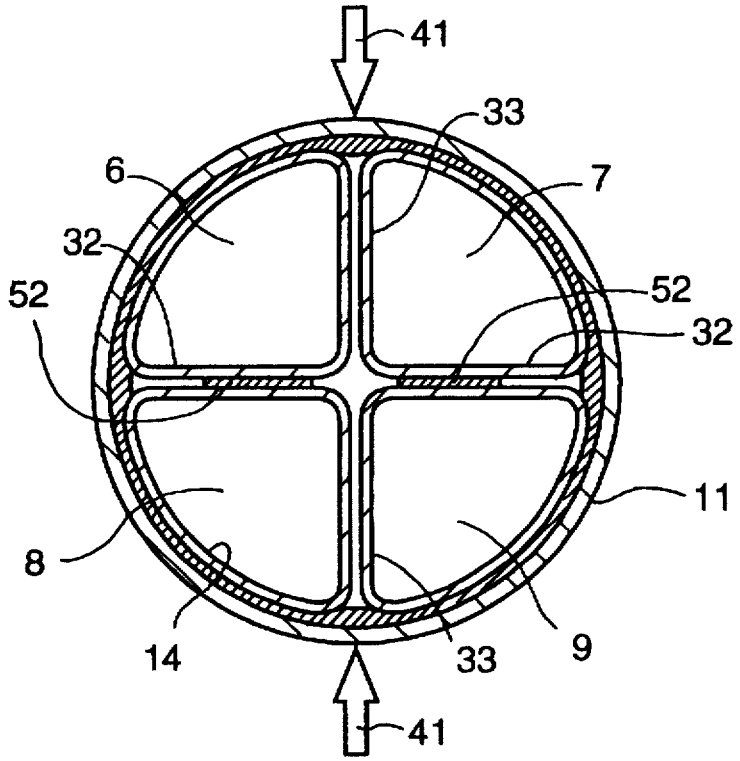
FIG. 27 is a cross-sectional view of an exhaust manifold branch collecting portion structure according to a fourteenth embodiment of the present invention (taken along line D—D of FIG. 45)
Figure 28:
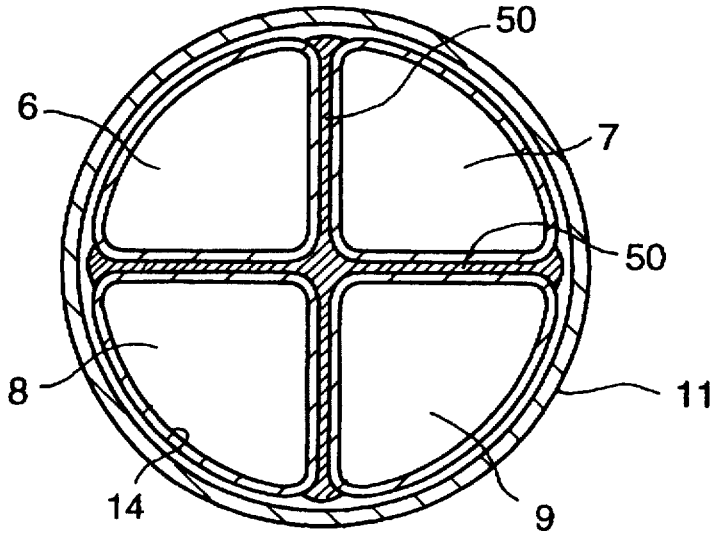
FIG. 28 is a cross-sectional view of the structure according to the fourteenth embodiment of the present invention (taken along line C—C of FIG. 45)

A fourteenth embodiment of the present invention is applied to the B-type structure. With the fourteenth embodiment of the present invention, as illustrated in FIG. 27 (a cross-section taken along line D—D of FIG. 45) and FIG. 28 (a cross-section taken along line C—C of FIG. 45), the exhaust manifold 10 includes four pipes 6, 7, 8, and 9, and therefore, the combined pipe portion 14 includes two partitioning walls 32 and 33 that cross to each other. In one 32 of the partitioning walls 32 and 33 that extend parallel to the longitudinal direction of the cylinder head, an additional weld 52 is formed so as to be spaced from the weld 50 formed at the downstream end of the partitioning wall 32. The additional weld 52 may be a spot or a seam weld.

In the fourteenth embodiment of the present invention, in the B-type structure, the adjacent pipes 6 and 8 are connected at welds 50 and 52, and the adjacent pipes 7 and 9 are connected at welds 50 and 52. As a result, the force 41 transmitting between the pipes 6 and 8 and between the pipes 7 and 9 are distributed through two routes (i.e., a route through the weld 50 and a route through the weld 52) so that a stress caused in the weld 50 is decreased, and a crack initiation at the weld 50 is unlikely to occur.

Figure 29:
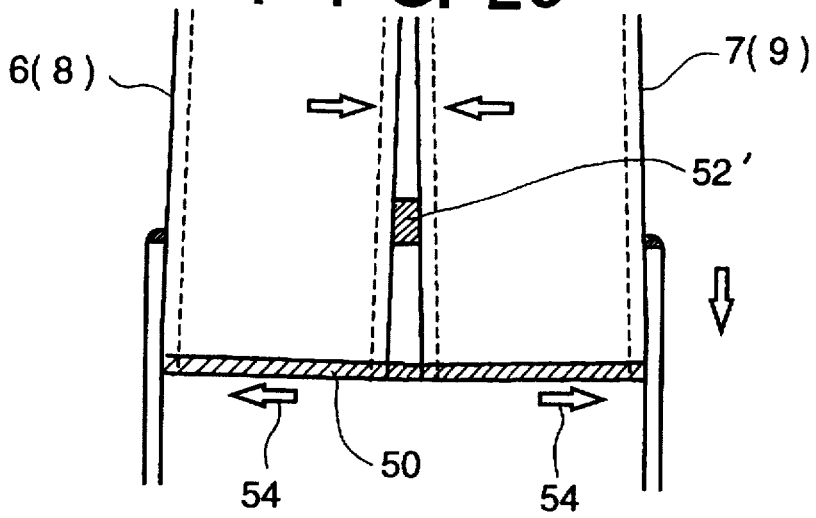
FIG. 29 is a cross-sectional view of a comparison where a weld line is provided in another partitioning wall and a large deformation is caused.
Figure 30:
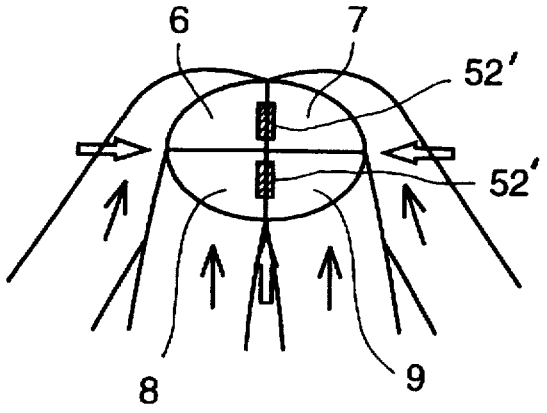
FIG. 30 is a plan view of the comparison of FIG. 29.
Figure 31:
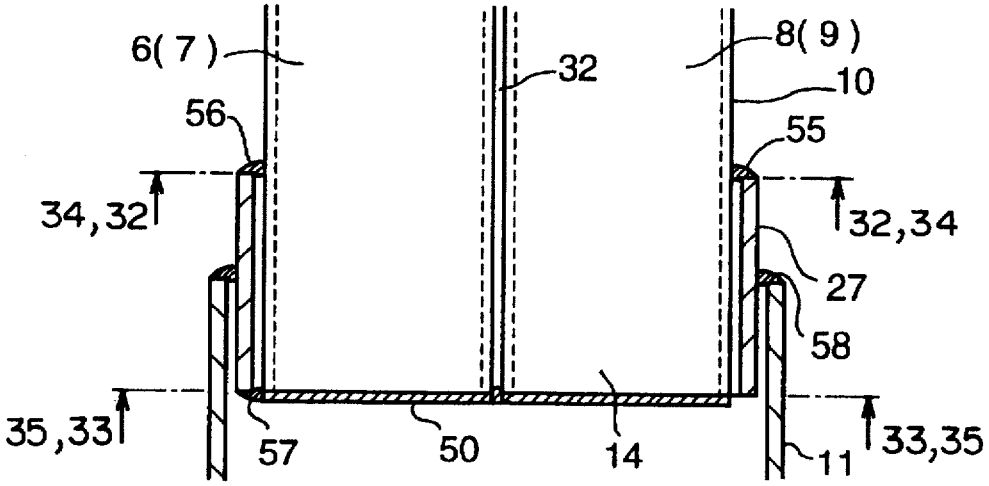
FIG. 31 is a cross-sectional view of an exhaust manifold branch collecting portion structure according to a fifteenth embodiment of the present invention.

In the B-type structure, if a weld 52' were provided in the other partitioning wall 33, as illustrated in FIGS. 29 and 30, a force 53 acting between pipes 6 and 7 would generate a force 54 which would promote deformation of the cross-section, which in turn would promote crack initiation at the weld 50. Therefore, a weld 52' should not be formed in the partitioning wall 33 in the B-type structure.

Figure 32:
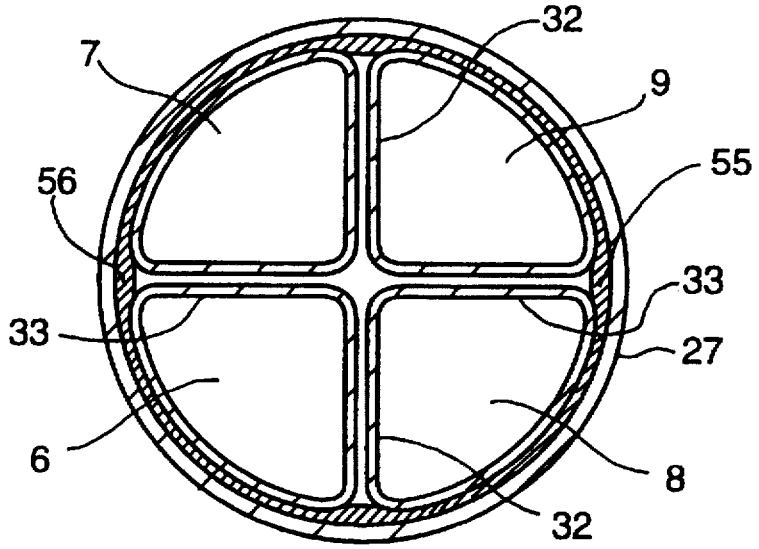
FIG. 32 is a cross-sectional view of the structure of FIG. 31 taken along line E—E of FIG. 31.
Figure 33:
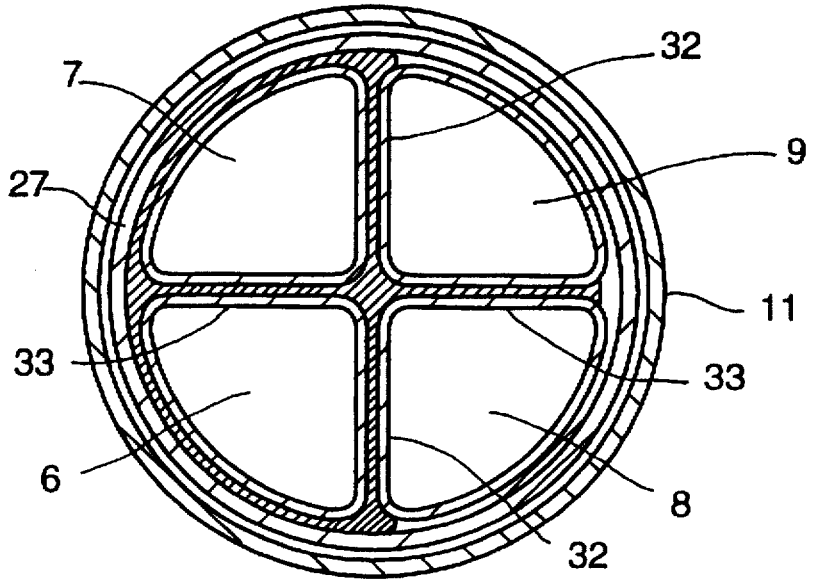
FIG. 33 is a cross-sectional view of the structure of FIG. 31 taken along line F—F of FIG. 31.

A fifteenth embodiment of the present invention is applicable to both of the A-type and B-type structures. With the fifteenth embodiment of the present invention, as illustrated in FIG. 32 (a cross-section taken along line E—E of FIG. 31) and FIG. 33 (a cross-section taken along line F—F of FIG. 31), a cylindrical intermediate member 27 is provided between the combined pipe portion 14 and the collecting pipe 11. The downstream end of the combined pipe portion 14 is inserted into the intermediate member 27, and at least a downstream end of the intermediate member 27 is inserted into an upstream end of the collecting pipe 11. The combined pipe portion 14 and the intermediate member 27 are welded together at an upstream end of the intermediate member 27 over an entire circumference of the intermediate member 27 (as shown by welds 55 and 56). The combined pipe portion 14 and the intermediate member 27 are welded together at the downstream end of the combined pipe portion 14 over only a half circumference, further from the cylinder head 1, of the intermediate member 27 (as shown by a weld 57). The intermediate member 27 and the collecting pipe 11 are welded together by a weld 58 over an entire circumference of the intermediate member 27 at an upstream end of the collecting pipe 11 which is located at an axially intermediate portion of the intermediate member 27.

When the fifteenth embodiment of the present invention is applied to the A-type structure, a strain that normally concentrates on the weld bead 58 is shared by the upstream weld bead 55, and a deformation of the cross-section of the combined pipe portion 14 is suppressed by the weld head 56. As a result, crack generation at welds 58 and 50 is suppressed.

When the fifteenth embodiment of the present invention is applied to B-type structures, a strain concentrating at weld bead 58 is distributed to the upstream weld bead 55 so that a force acting to deform the cross-section of the combined pipe portion 14 is decreased. Further, stiffness of the combined pipe portion 14 is increased by the weld bead 57. As a result, deformation of the cross-section of the pipe combined portion 14 and crack initiation at the weld 50 are suppressed.

Figure 34:
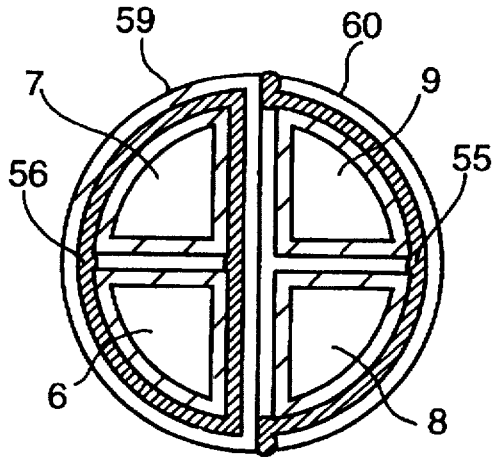
FIG. 34 is a cross-sectional view of an exhaust manifold branch collecting portion structure according to a sixteenth embodiment of the present invention taken along line corresponding to line E—E of FIG. 31.
Figure 35:
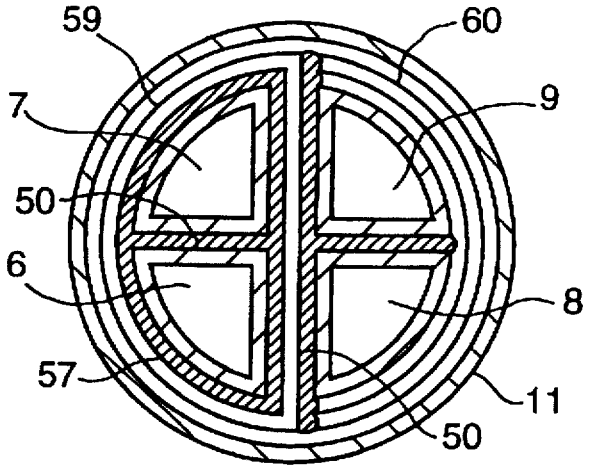
FIG. 35 is a cross-sectional view of the structure according to the sixteenth embodiment of the present invention taken along a line F—F of FIG. 31.

A sixteenth embodiment of the present invention is a variation of the fifteenth embodiment of the present invention, wherein a stiffness of the combined pipe portion 14 is further increased. In the sixteenth embodiment of the present invention, as illustrated in FIG. 34 (a cross-section taken along line E—E of FIG. 31) and FIG. 35 (a cross section taken along line F—F of FIG. 31), the intermediate member includes a first collar 59 and a second collar 60. The first collar 59 includes a semicircular wall and a straight wall that connects opposite ends of the semicircular wall, and the second collar 60 includes a semicircular wall only. The exhaust manifold 10 includes a first group of pipes (longer pipes) 6 and 7 having vertically curved portions spaced from the cylinder head by a first distance and a second group of pipes (shorter pipes) 8 and 9 having vertically curved portions spaced from the cylinder head by a second distance shorter than the first distance. The longer pipes 6 and 7 are inserted into the first collar 59, and are welded to the first collar 59 at an upstream end and a downstream end of the first collar 59 (as shown by welds 56 and 57, respectively). The shorter pipes 8 and 9 are inserted into the second collar 60 at an upstream end of the second collar 60 only (as shown by a weld 55).

In the sixteenth embodiment of the present invention, due to the straight wall of the first collar 59, the stiffness of the intermediate member is increased. As a result, the cross-sectional deformation of the combined pipe portion 14 is suppressed and crack initiation at the weld 50 is also suppressed.

According to the present invention, the following advantages are obtained.

More particularly, according to the first embodiment of the present invention, because the intermediate member 27 is provided, a moment acting on the welds formed at the partitioning walls of the combined pipe portion 14 is decreased, and structural reliability of the welds is improved.

According to the second embodiment, because the axial length of the extended portion of the collecting pipe is changed according to a circumferential position, the moment acting on the combined pipe portion 14 is distributed by the extended portion so that a moment acting on the weld at the downstream end of the combined pipe portion 14 is decreased. Further, an increase in weight is also suppressed.

According to the third to sixth embodiments of the present invention, because the weld parallel to the longitudinal direction of the cylinder head is zigzagged in the axial direction of the combined pipe portion 14, the point of maximum stress generation is shifted from the center to a position radially spaced from the center, so that the stress at the center is decreased and structural reliability is increased.

According to the seventh to ninth embodiments of the present invention, because the weld line is axially spaced from the maximum stress generating point, crack initiation at the weld line is suppressed.

According to the tenth and eleventh embodiments of the present invention, because only one of the crossing partitioning walls is curved, the stress acting on the weld line is decreased, maintaining the cross-sectional stiffness of the combined pipe portion 14.

According to the twelfth embodiment of the present invention, because the downstream ends of the partitioning walls are convex in the downstream direction, a force acting opposite to a compression force is caused at the downstream end of the partitioning wall, so that crack initiation at the weld is suppressed.

According to the thirteenth and fourteenth embodiments of the present invention, because an additional weld 51, 52 is provided, the force acting on the weld 50 at the downstream end of the partitioning wall is decreased.

According to the fifteenth and sixteenth embodiments of the present invention, because the intermediate member 27 and the combined pipe portion 14 are welded over a half circumference at the downstream end of the intermediate member, the crack initiation at the welds formed at the downstream end of the partitioning walls is suppressed, maintaining the stiffness of the combined pipe portion.

Although the present invention has been described with reference to specific exemplary embodiments, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. An exhaust manifold branch collecting portion structure, said structure being connected to a cylinder head at one end of said structure, said structure comprising:

an exhaust manifold including a plurality of pipes having downstream ends, each of said downstream pipe ends having a pie-shaped cross-section having two straight sides and one arc-shaped side, said downstream pipe ends being assembled with the said straight sides of the pie-shaped cross-sections of adjacent downstream pipe ends contacting each other to form partitioning walls and being welded together at downstream ends of said partitioning walls to form a combined pipe portion having a circular cross-section;

a cylindrical intermediate member receiving therein at least a downstream end of said combined pipe portion and welded to said combined pipe portion; and a collecting pipe having an upstream end receiving therein at least a downstream end of said intermediate member and welded to said intermediate member.

2. A structure according to claim 1, wherein said combined pipe portion of said exhaust manifold and said intermediate member are welded together over an entire circumference of said intermediate member, and said intermediate member and said collecting pipe are welded together over the entire circumference of said intermediate member.

3. A structure according to claim 2, wherein said combined pipe portion of said exhaust manifold and said intermediate member are welded together both at an upstream end of said intermediate member and at a downstream end of said combined pipe portion, and said intermediate member and said collecting pipe are welded together at an upstream end of said collecting pipe.

4. A structure according to claim 1, wherein said intermediate member and said collecting pipe are welded together over an entire circumference of said intermediate member, at an upstream end of said collecting pipe.

* * * * *